United States Patent [19]

Suzuki et al.

[11] Patent Number: 4,737,821

[45] Date of Patent: Apr. 12, 1988

[54] COLORED IMAGE RECORDING DEVICE

[75] Inventors: Kohji Suzuki; Tsutomu Shoji, both of Yokohama; Hideo Yoo, Tokyo, all of Japan

[73] Assignee: Ricoh Corporation, Japan

[21] Appl. No.: 898,981

[22] Filed: Aug. 22, 1986

[30] Foreign Application Priority Data

| | | | |
|---|---|---|---|
| Aug. 31, 1985 | [JP] | Japan | 60-192462 |
| Aug. 31, 1985 | [JP] | Japan | 60-192463 |
| Aug. 31, 1985 | [JP] | Japan | 60-192464 |
| Sep. 4, 1985 | [JP] | Japan | 60-195451 |
| Sep. 4, 1985 | [JP] | Japan | 60-195452 |

[51] Int. Cl.[4] ..... G03G 15/01

[52] U.S. Cl. ..... 355/4; 355/3 CH; 355/14 D; 430/54; 430/42; 118/645

[58] Field of Search ..... 355/3 R, 4, 14 R, 3 FU, 355/14 FU, 3 CH, 14 CH; 430/45, 52, 54, 120; 118/647, 645

[56] References Cited

U.S. PATENT DOCUMENTS

| | | | |
|---|---|---|---|
| 3,815,988 | 6/1974 | McVeigh et al. | 355/4 X |
| 3,972,608 | 8/1976 | Moriyama et al. | 355/4 |
| 4,589,035 | 5/1986 | Yamanishi et al. | 355/4 X |
| 4,599,285 | 7/1986 | Haneda et al. | 355/4 X |
| 4,682,880 | 7/1987 | Fujii et al. | 355/4 |

FOREIGN PATENT DOCUMENTS

| | | |
|---|---|---|
| 1489142 | 5/1975 | United Kingdom . |
| 1558341 | 7/1976 | United Kingdom . |
| 2140924A | 12/1984 | United Kingdom . |

*Primary Examiner*—A. C. Prescott

*Attorney, Agent, or Firm*—Mason, Fenwick & Lawrence

[57] ABSTRACT

In an image recording device, particularly suitable for the reproduction of colored images, two images are superimposed on a recording sheet. The second image is so designed that it compensates the undesirable saturation of density under an ordinary condition and that the superimposed image has an improved tone reproduction. The superimposed toner images are heat-fixed together on the print.

47 Claims, 47 Drawing Sheets

| | |
|---|---|
| Fig.1 (i) | Fig.1 (ii) |
| Fig.1 (iii) | Fig.1 (iv) |

Fig. 1 (ii)
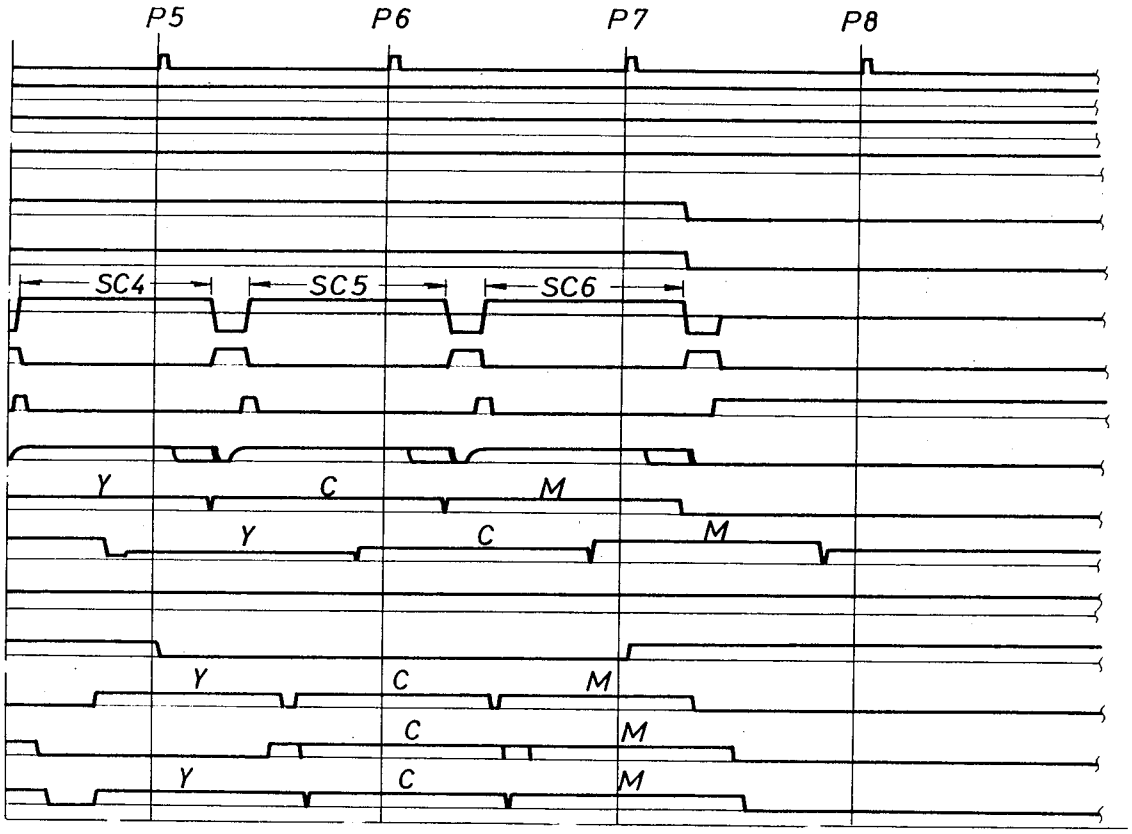
| | |
|---|---|
| Fig. 1 (i) | Fig. 1 (ii) |
| Fig. 1 (iii) | Fig. 1 (iv) |

Fig. 1 (iii)
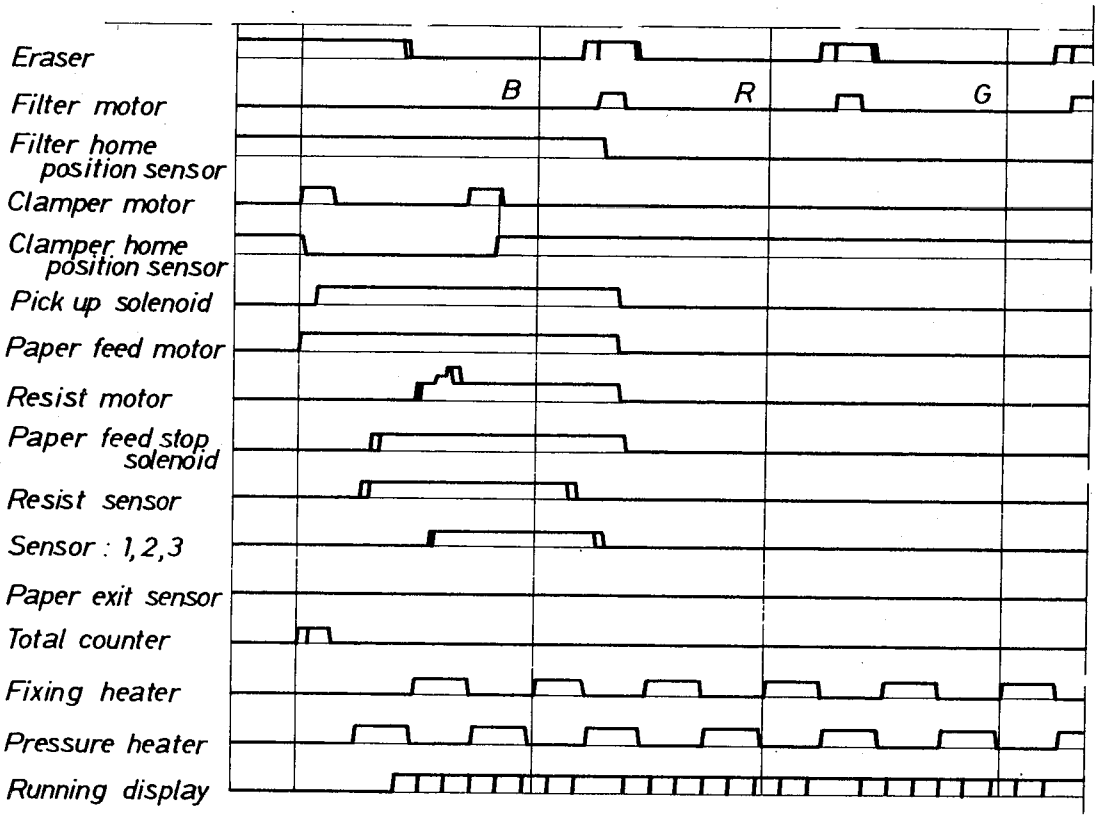
| | |
|---|---|
| Fig. 1 (i) | Fig. 1 (ii) |
| Fig. 1 (iii) | Fig. 1 (iv) |

Fig.1 (iv)
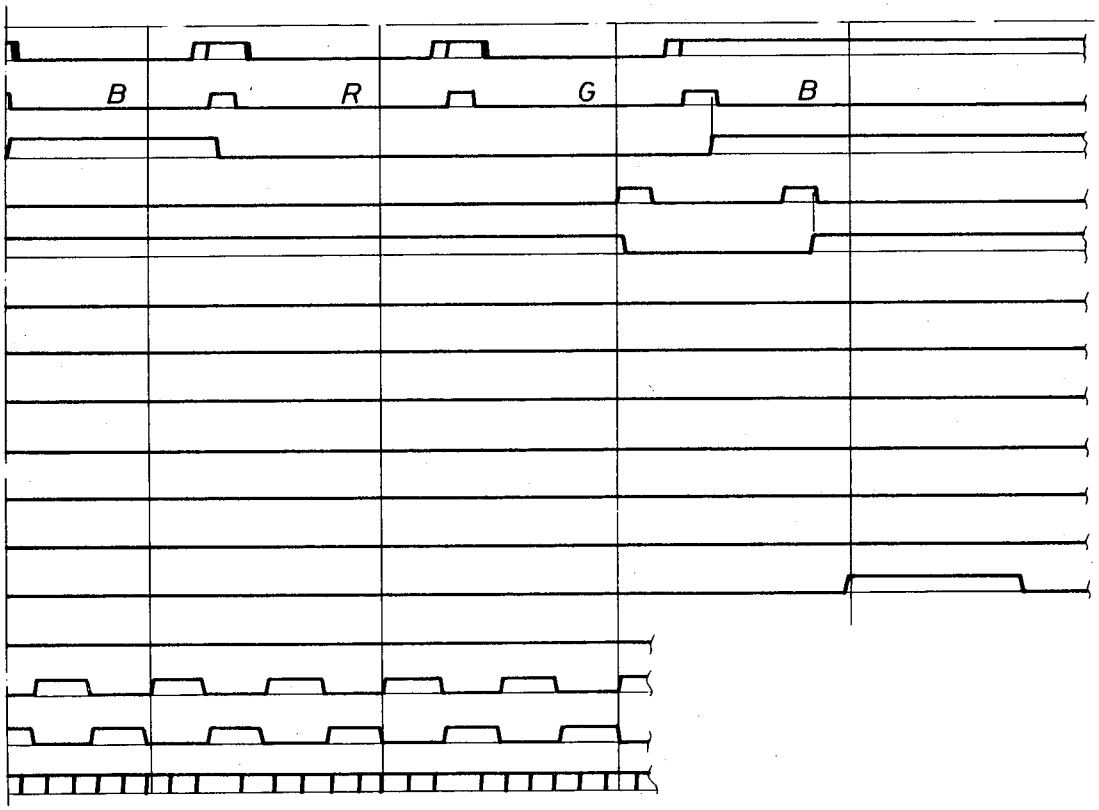
| | |
|---|---|
| Fig. 1 (i) | Fig. 1 (ii) |
| Fig. 1 (iii) | Fig. 1 (iv) |

Fig. 5a (ii)
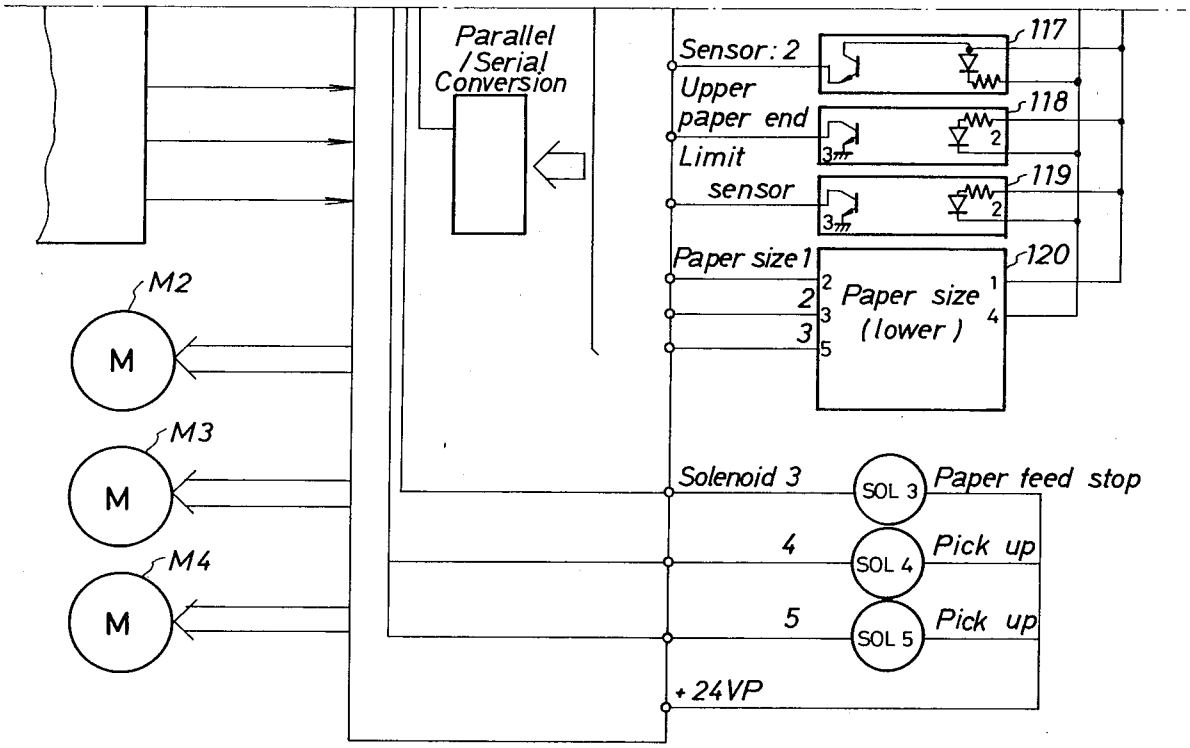
Fig. 5a (i) | Fig. 5a (ii)

Fig. 5b (ii)

Main control board
100
Development control board
120
Timing (Y)
(C)
(M)
Toner end
Reset
Toner reset
+15V
(Y)
(C)
(M)
DB7
RESET
TO
P10
P11
P12
P14
P20
P25
DPS
601
602
603
(M)
(C)
(Y)
121
+5V
Toner feed display
Density display
DB 6
DB 0
to Toner feed motor
+24VP
+15V
+5V
GNDL
GNDP
+24VP
Pick up
Y
C
M
MC
Development unit (Y)
122
M
L Sensor
Development Roller
+24VP
Toner feed
+24VP
Mainmagnet solenoid
L-1
L-0
GND
Oscillation Circuit

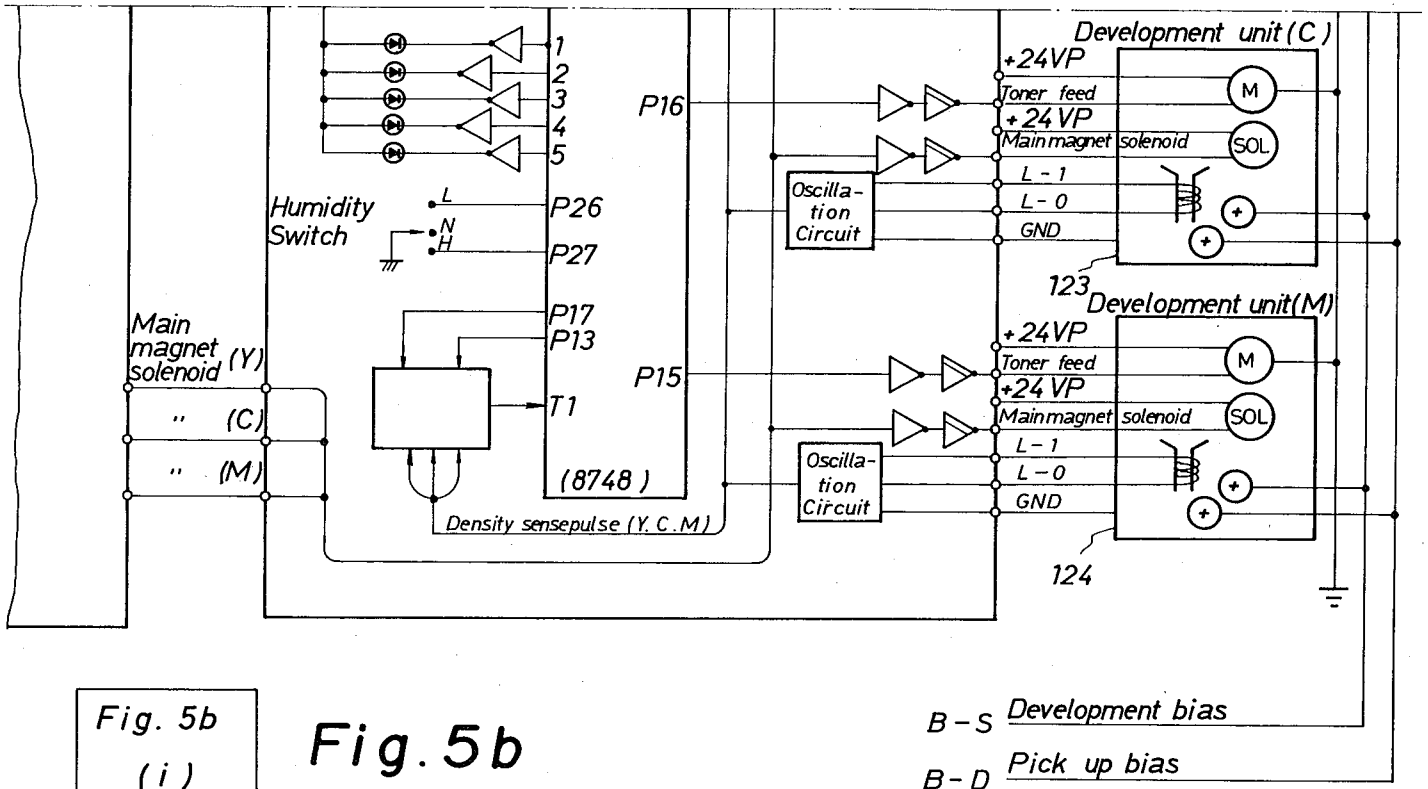
Fig. 5b (ii)
| Fig. 5b (i) |
|---|
| Fig. 5b (ii) |

Fig. 5c (ii)
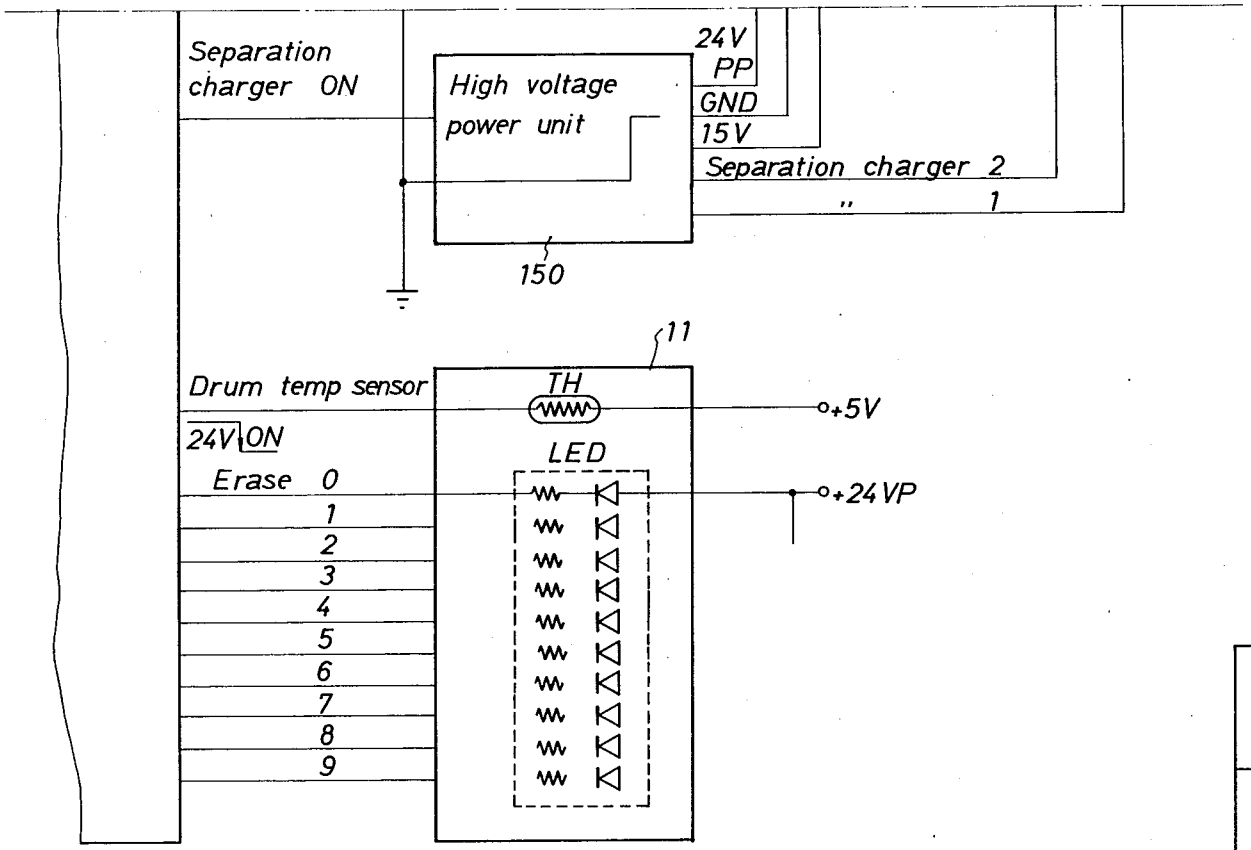
| Fig. 5c (i) |
|---|
| Fig. 5c (ii) |

| Fig.5d (i) | Fig.5d (ii) | Fig.5d (iii) |
|---|---|---|

Fig. 5d (ii)
| Fig. 5d (i) | Fig. 5d (ii) | Fig. 5d (iii) |
|---|---|---|
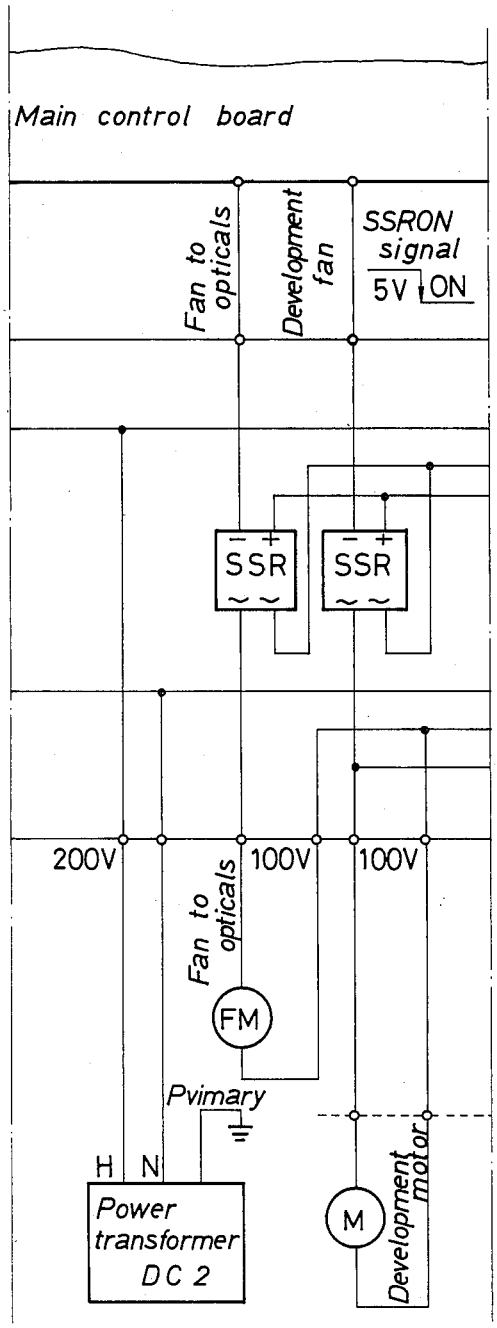

(iii)

| Fig. 5d (i) | Fig.5d (ii) | Fig.5d (iii) |
|---|---|---|

| | |
|---|---|
| Fig. 7 (i) | Fig. 7 (ii) |
| Fig. 7 (iii) | Fig. 7 (iv) |

Fig. 7 (ii)
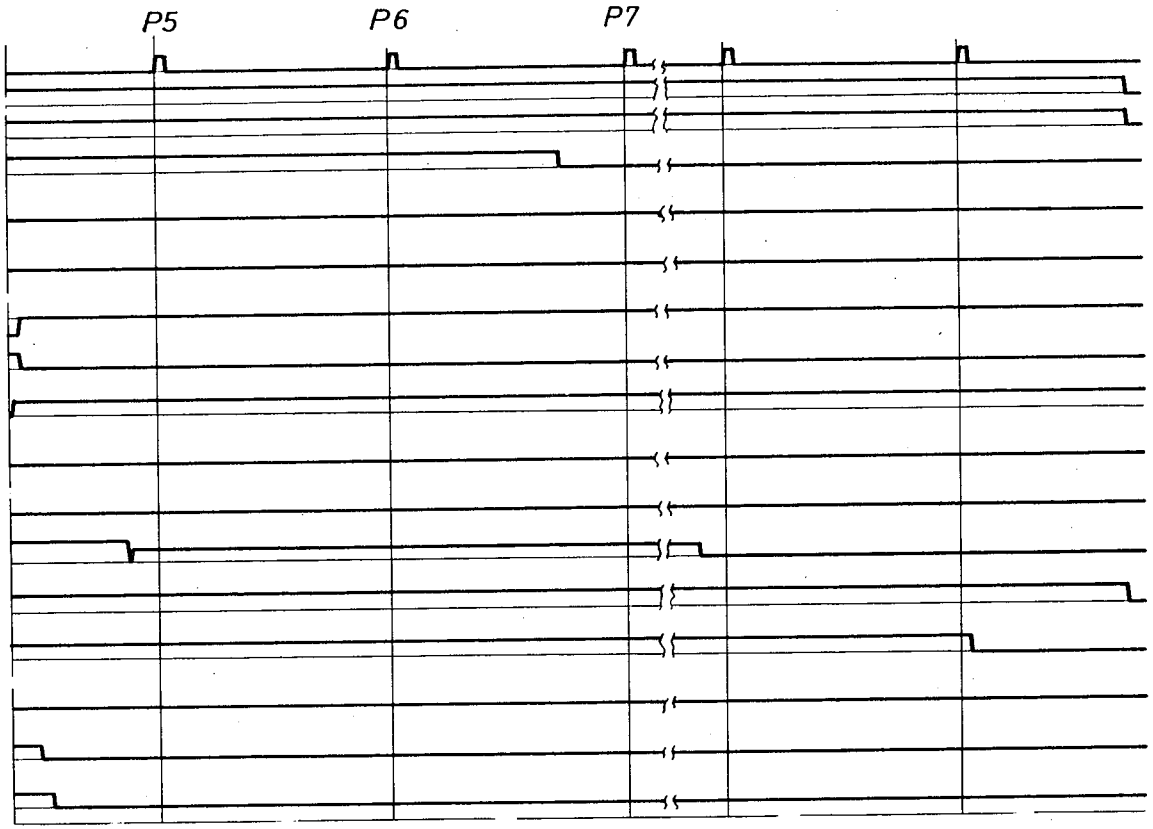
| | |
|---|---|
| Fig. 7 (i) | Fig. 7 (ii) |
| Fig. 7 (iii) | Fig. 7 (iv) |

Fig.7 (iii)
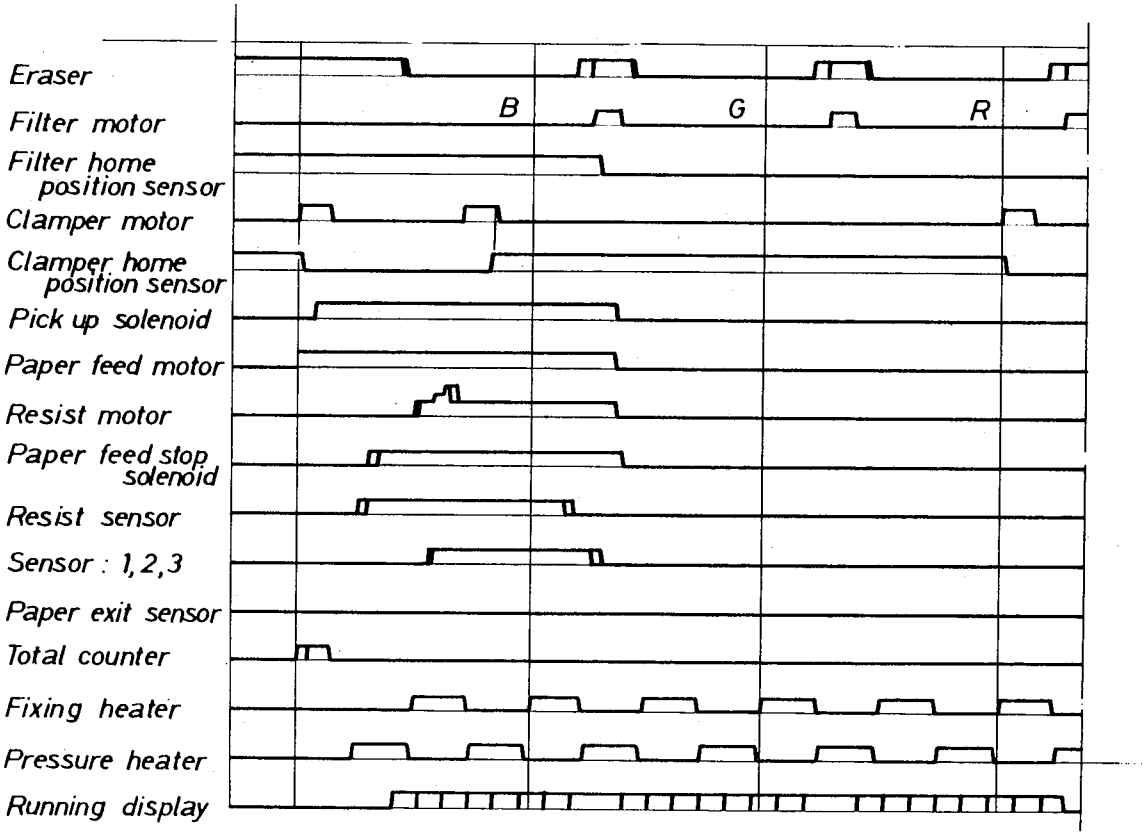
| | |
|---|---|
| Fig.7 (i) | Fig.7 (ii) |
| Fig.7 (iii) | Fig.7 (iv) |

Fig.7 (iv)
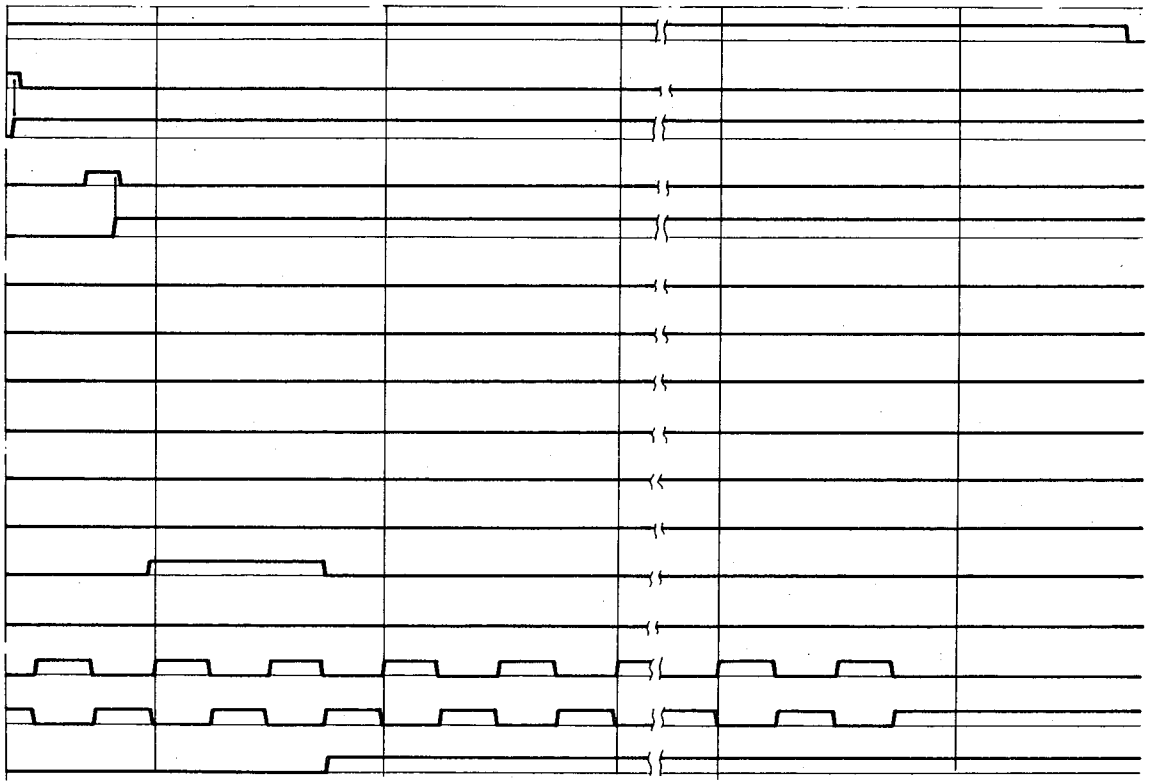
| | |
|---|---|
| Fig.7 (i) | Fig.7 (ii) |
| Fig.7 (iii) | Fig.7 (iv) |

Fig. 8 (ii)

Fig. 8 (ii)
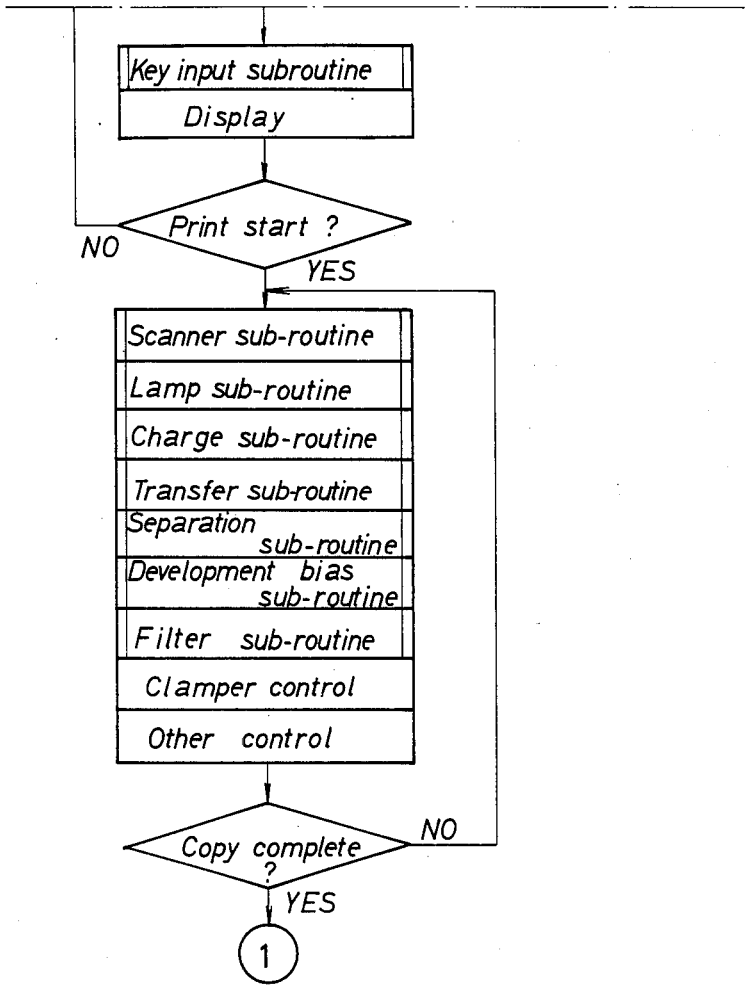
| |
|---|
| Fig. 8 (i) |
| Fig. 8 (ii) |

Fig. 9a (ii)

| Fig. 9d (i) | Fig. 9d (ii) |
|---|---|

Fig. 10c (ii)
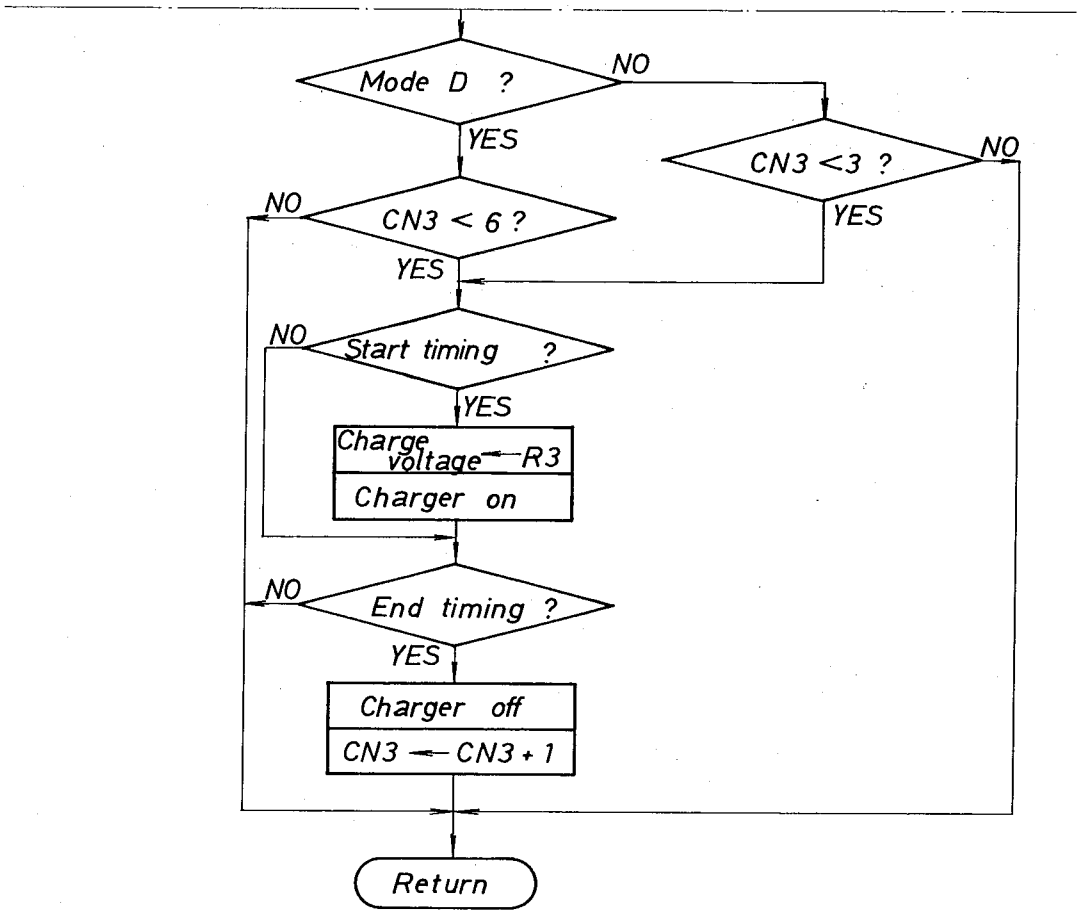
| Fig. 10c (i) |
|---|
| Fig. 10c (ii) |

Fig.10f (ii)
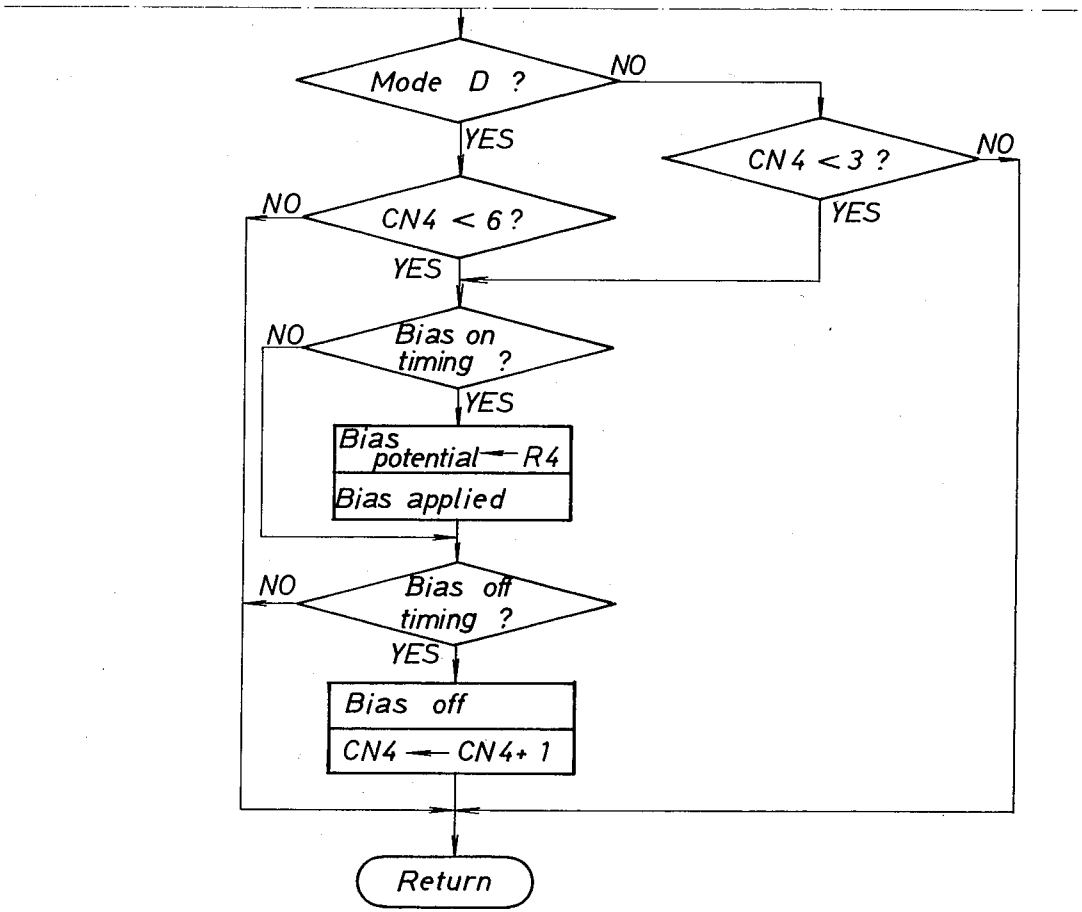
| Fig. 10f (i) | Fig. 10f (ii) |
|---|---|

Fig. 11

| | Y | C | M |
|---|---|---|---|
| MI1 | | | |
| MI2 | | | |
| MI3 | | | |
| MN1 | | | |
| MN2 | | | |
| MN3 | | | |
| MA1 | | | |
| MA2 | | | |
| MA3 | | | |
| MB1 | | | |
| MB2 | | | |
| MB3 | | | |
| MC1 | | | |
| MC2 | | | |
| MC3 | | | |
| MD1 | | | |
| MD2 | | | |
| MD3 | | | |

| | |
|---|---|
| Fig. 12 (i) | Fig. 12 (ii) |
| Fig. 12 (iii) | Fig. 12 (iv) |

Fig.12 (ii)
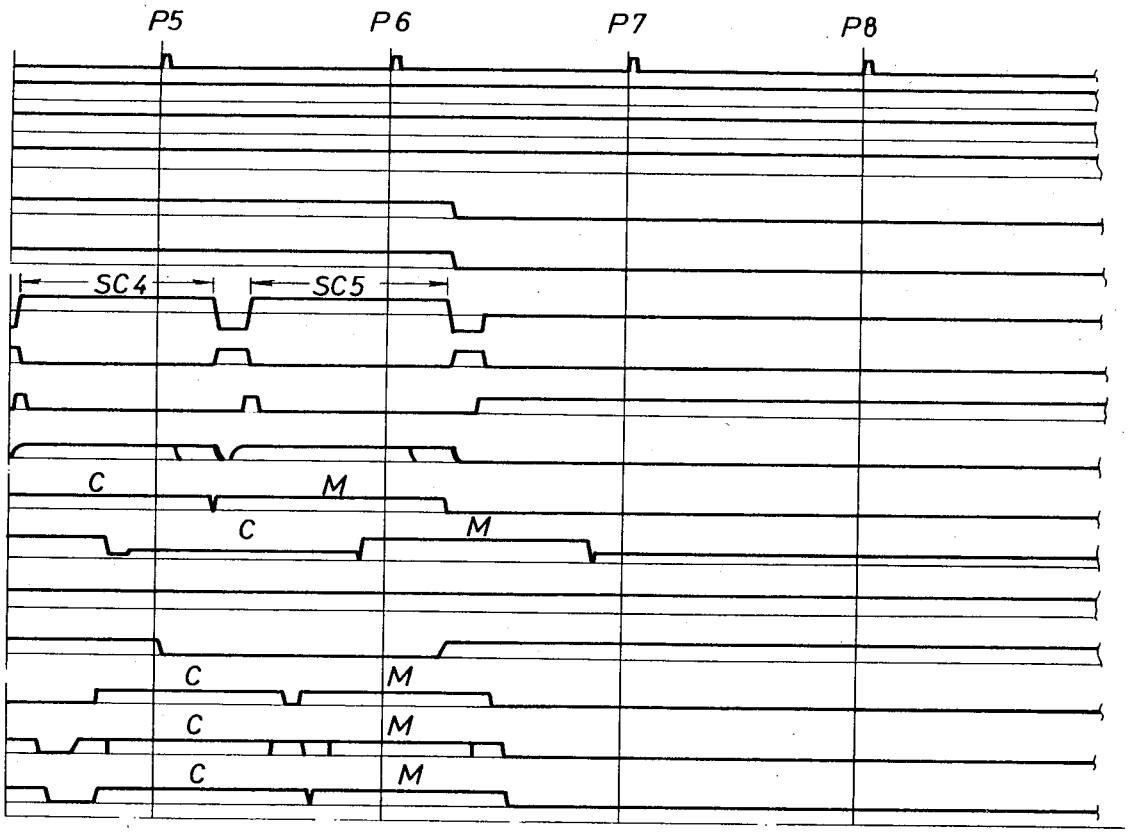
| | |
|---|---|
| Fig. 12 (i) | Fig. 12 (ii) |
| Fig. 12 (iii) | Fig. 12 (iv) |

Fig. 12 (iii)
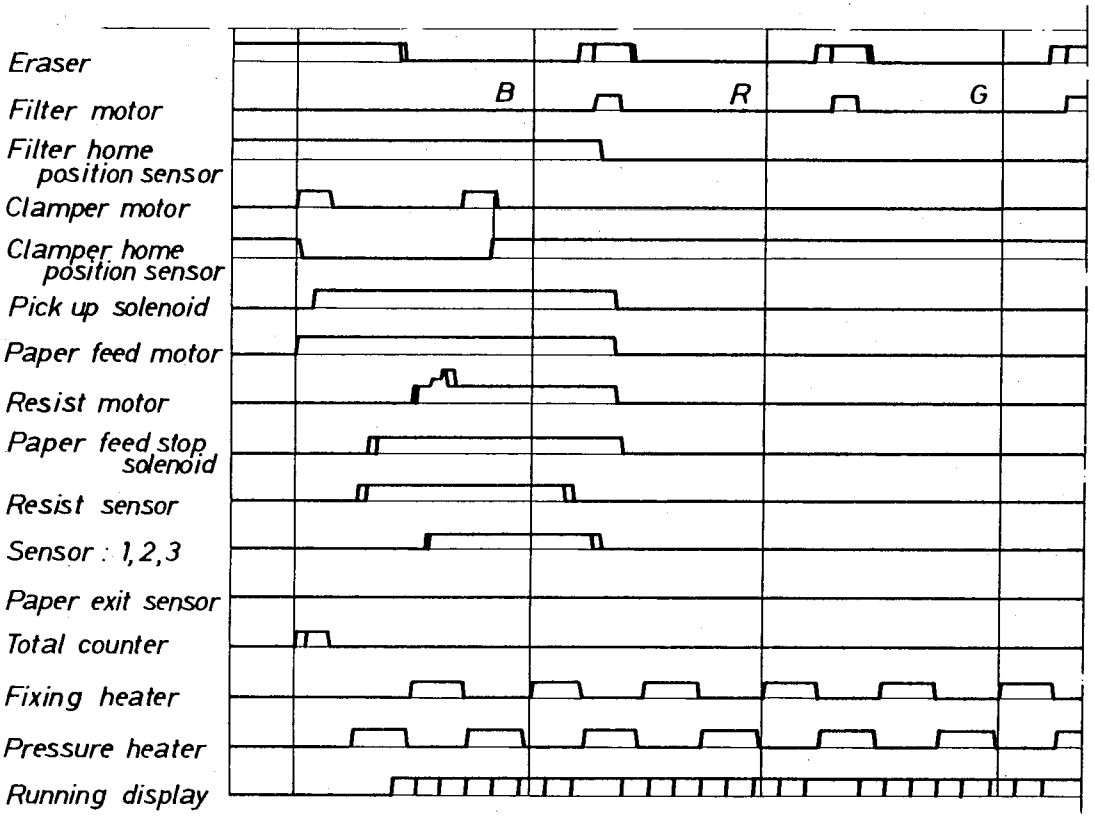
| | |
|---|---|
| Fig. 12 (i) | Fig. 12 (ii) |
| Fig. 12 (iii) | Fig. 12 (iv) |

Fig. 12 (iv)
| | |
|---|---|
| Fig. 12 (i) | Fig. 12 (ii) |
| Fig. 12 (iii) | Fig 12 (iv) |
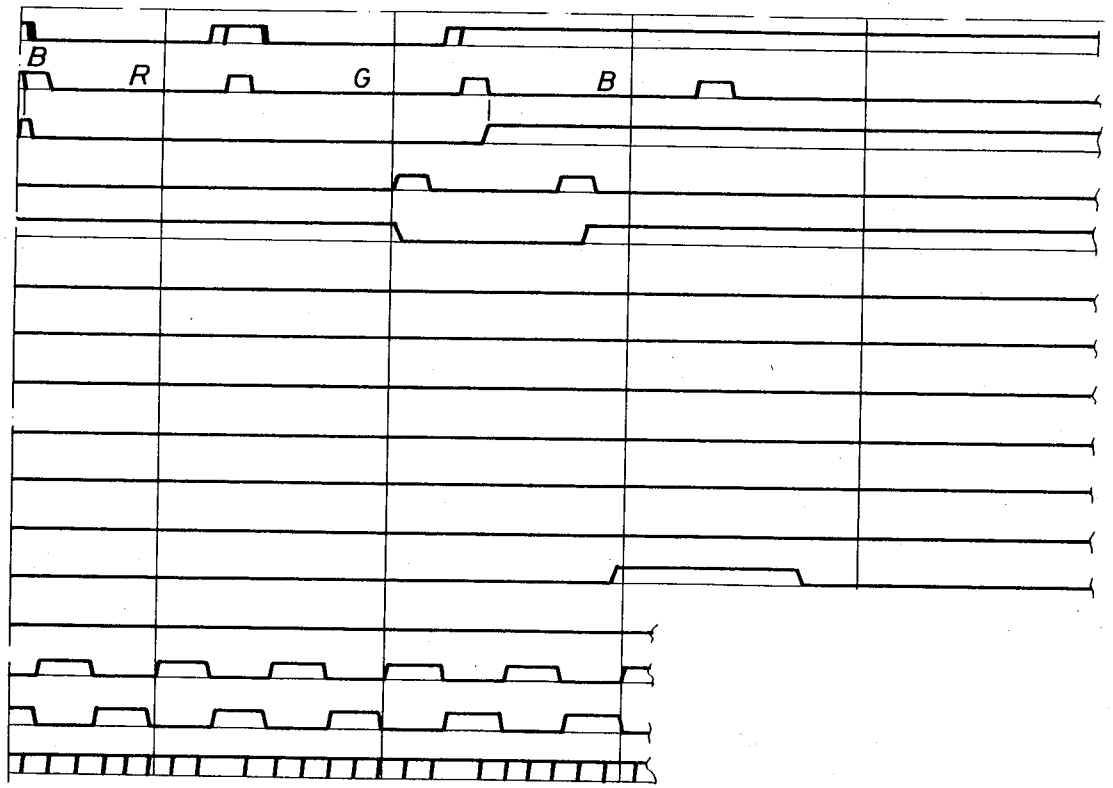

COLORED IMAGE RECORDING DEVICE

BACKGROUND OF THE INVENTION

The present invention relates to an image recording device of electrostatic transfer type with improved tone reproduction capability and, more particularly, to a colored image recording device with improved original-versus-copy density relationship, which offers a wide range of gradient linearity in $\gamma$(gamma)-value and is especially suitable for the reproduction of originals having not only highlight and shadow areas but also half toned areas.

More than 40 years has passed since the principle of electrophotography of practical use was first introduced by Carlson. In an image recording device according thereto, like an electrostatic or xerographic copier, a series of processes are performed, such as a uniform electrostatic charge imparted on a photoconductive insulating surface, a local charge dissipation giving a latent image corresponding to a light pattern, a development with colored developer visualizing the latent image, a transfer of the visualized image to a recording sheet and a fixation to obtain the recording sheet with the transferred image.

Needless to say, tone reproduction with complete fidelity is preferred. In terms of gradation, a linear relationship between the density of the original manuscript (OD) and that of the copied output (CD) is necessary. However, the electrical potential of conventional photoconductive material undergoes a decay in a fashion far from ideal and, as shown in FIGS. *6a, 6b* and *6c*, a linearity in the OD-CD relationship is unavilable, particularly with a higher OD, where the CD saturates to a certain level and the original gradation cannot be reproduced.

Particularly in a multichromatic "full color" copier, a saturation in one color results in an unbalance in hue to give a different color from the original. As shown in FIGS. *6a, 6b* and *6c*, wherein the development bias potential, the amount of exposure and the charge voltage of the photoconductive layer, respectively, are modified, the OD-CD relationship, such as contrast and saturation, can be adjusted in various ways. However, these Figures tell that, with any of these modifications of such parameters, a linear relationship can be maintained in a relatively small range only. Accordingly, many kinds of parameter modification means are provided with conventional copiers, which are to be controlled to give the best possible tone reproduction relating to the particular type of the original image. Many skillful tests are necessary for this purpose, but in spite of these a continuous tone illustration like a photograph cannot be reproduced satisfactorily even by well-trained staffs, because of its wide range in gradation.

Photographic density or optical density is a degree of opacity. It is the ratio of the intensity of light projected to the image in dispute to the intensity of light which has passed through the image. Practically, however, the density $D_R$ is defined as:

$$D_R = \log (Rw/R)$$

wherein R is the intensity of light reflected to the perpendicular direction when certain amount of light is projected from the 45° angle to the image and Rw is the reflection measured for a white sheet in the same manner.

SUMMARY OF THE INVENTION

It is therefore an object of the present invention to provide an improved tone reproduction by an electrostatic recording device which offers a wide range of gradient linearity in $\gamma$-value.

In order to attain the above object, according to the present invention, two different images are superimposed on the same recording sheet. The idea of the superimposition in itself is known to the art: U.S. Pat. No. 2,868,642 to R. E. Hayford et al. They found that the range of density over which a xerographic print conforms to the original tones of a picture can be increased by repetitive cycles of charging, exposure and powder cloud development. The present invention relates to a practical and useful improvement of their historical but yet uncommercialized idea and offers a dynamic range (an OD range within which an acceptable linearity is maintained) as wide as 0.2–1.5.

By modifying, for example, the amount of exposure, the OD-CD relationship can be shifted as shown in FIG. *6b* and two separate characteristics, marked as A and B in FIG. *6d*, respectively, may be obtained. By adding up these two, the A+B characteristic has a wider range of acceptable tone reproduction, which conforms better to the ideal property.

In an attempt to realize the above, the parameters are first set so as to give the characteristic A, under which the machine is operated till the transfer process, but not the fixation process, unlike Hayford et al., whereby the parameters are re-modified to give the characteristic B, under which the second image is formed and transferred. After the two images are transferred to a recording sheet, they are fixed together thereon. Thus, on the recording sheet, a high-quality image is reproduced according to the A+B characteristic.

When a colored image is to be recorded, these cycles are repeated with respect to each of Y (yellow), C (cyan) and M (magenta), the order being optional. In a full-color image recording device of electrostatic transfer type, a trichromatic (3-colored) method is popular, but it is optional to make it tetrachromatic by adding black, whereby the black accentuates shadows and detail. The black color is also useful for a monochromatic copy of superior tone reproduction.

Thus, in accordance with the present invention, the first setting means relating to at least one parameter capable of adjusting the density of the copied image at the first cycle and then the second setting means relating to at least one parameter capable of adjusting the density of the copied image at the second cycle are provided. Under the first setting means, the first cycle is performed, while, under the second setting means, the second cycle is done. The two setting means can separately set the parameters suitable for the respective cycle and, with the combination of the two, the OD-CD relationship can be adjusted relatively freely.

For the sake of convenience, a built-in memory stores the digital values of the parameters suitable for the respective cycles. It is possible to change these values in case of need. At each cycle of the operation, the machine reads the parameters, converts the digital data to analogs and proceeds accordingly.

The parameters are to be established with respect to each separated color. Few conventional photoconductive materials have a feat spectral response: amorphous selenium has a very poor photosensitivity in the red end. Addition of tellurium, selenium and/or antimony extends the range of spectral sensitivity towards the red, but the improved spectrum is still far from flat. Accordingly, the parameters should have been so chosen as to compensate the unequal sensitivity with each color.

Some organic semiconductive material, as an equimolecular mixture of polyvinyl carbazole and 2,4,7-trinitro-9-fluorenone, has an almost panchromatic response and may be preferably used for the device in accordance with the present invention. Vitreous silicon has also a better spectral response than selenium.

In practicing the present invention, however, there are quite a few parameters to modify. It is essential that different conditions are to be set between the two cycles. There are at least three kinds of parameters capable of adjusting the density of the copied image. At least three colors are to be adjusted for a full-color image, and so on. If any one of them is changed individually, a number of test copies are necessary to study the result.

It is very seldom, if any, that the summed characteristic A+B should be other than linear in shape. If it is set linear at the initial stage, equal amount of modification relating to the corresponding parameters for each of the two cycles will do most of the time.

In a preferred embodiment of the present invention, accordingly, parameters for the first and second cycles are modified similarly in association with each other when a different combination of parameters becomes necessary. This will become apparent from the following detailed description with reference to the examples.

In another preferred embodiment of the present invention, a quadratic equation is given in advance, according to which, when one parameter is set for one cycle, the corresponding parameter for the other cycle is calculated automatically. The type of the empirical equation for this purpose depends on characteristics of the machine, such as of photoconductive material, users' taste, type of manuscript, etc. Typical, but non-limiting examples are:

| | A | B | Ratio (B/A) |
|---|---|---|---|
| Charger output (kV) | 5.5 | 5.5 | 1.0–0.5 |
| Exposure (Lamp Voltage) | 110 | 170 | 1.3–2.0 |
| Development Bias (V) | 196 | 280 | 1.0–2.0 |

Although a very vivid color is reproduced by the full color process explained herein, the process is not very fast. Each of the two cycles has three colors to record and, assuming that one image forming and its transfer will take four seconds, it will take 24 seconds for a copy. Attempts have been made to reduce this time without detrimenting the quality too much.

Among three colors of yellow, cyan and magenta, human vision is rather insensitive with gradation in some color such as yellow. In another embodiment of the present invention, in view of this fact, the first cycle is performed normally (Y, C and M) while in the second yellow is omitted (C and M only).

Alternatively, if the quality requirement is mild, a single cycle output may be sufficient. Color subjects, such as illustrations, charts, brochures, etc., usually contain only the more saturated colors, which do not need the sophisticated dual cycled superimposition in accordance with the present invention.

In one embodiment in accordance with the present invention, therefore, a switch means is provided, by which one of the plurality of the operation modes can be selected. As will be explained hereinafter in detail referring to the example, two full cycles are conducted under Mode D (a high quality mode), while the recording sheet is outputted after the first cycle under other high-speed modes.

Controlled development of electrostatic images can be accomplished by several techniques. The most preferred one for the purpose of the present invention is the magnetic brush development, although other means may be used.

The brush in the magnetic brush development is a chainlike series of ferromagnetic powder attached to each other by magnetic attraction. When a powdered resinous pigment or toner is applied to the brush the toner particles cling to the ferromagnetic fibers by triboelectric attraction. Image development is accomplished simply by brushing the surface of the xerographic plate.

Recommended developer suitable for the magnetic brush development comprises two components: carrier and toner. The carrier is typically an iron granule of 0.05–0.2 mm in size, while the toner is a powdered organic resin of 7–20 microns in size with colored pigment or dye dispersed therein. The resin is preferably non-crystalline polyester which fuses well below 190° C., this temperature being the fixing condition. When fixed, the resin fuses to stick to the recording sheet and thereby captures the pigment or dye at the place where it is.

A single component toner is known to the art but is not recommended here. To make it magnetically conductive, it inevitably contains metallic substance, which is transferred to the recording sheet and remains there to increase the opacity of the fixed toner and to give a rather dark image.

It is customary to apply a bias potential at the time of development. The static potential upon the photoconductive material does not fade away completely even at a highlight end, a highly exposed area, so that the residual potential, say 100 V, must be overcome by the application of a higher bias potential, e.g. 150 V. Otherwise, the toner will stick to the highlight end also, which must be left blank.

This bias potential is one of the parameters utilized for the control of the density of the recorded image. FIG. *6a* shows this relationship.

An exact positioning (mechanical registration) is essential in a dual cycled superimposition, in which image formation, development and transfer are accomplished a couple of times on a single recording sheet. In a preferred embodiment of the present invention, in this sense, a transfer drum is placed in close proximity of a photoconductive drum (charge support means), on the former of which a recording sheet support means, a mechanical clamp, is provided. Moreover, the two drums are interconnected with each other by means of gears so that a precise synchronization of the two is guaranteed. Thus, the recording sheet is held securely on the transfer drum and the transfer processes are accomplished in synchronization with the rotation of the two drums, so that the images formed at each of any two operations do not slip with each other. This is particularly important in a multichromatic recording, whereby image formation and transfer thereof are repeated a number of times with different color developers.

It is essential to perform all of these transfers while the recording sheet is held securely on the transfer drum. Only after that, the recording sheet is separated and proceeds to the fixation means, where the final (color) image is fixed on the print.

The transfer drum is usually covered with a film of polymeric material, which is dielectric and capable of accomodating only a limited amount of static charge. Repeated transfer processes will lead to a saturation and thereafter satisfactorily uniform transfer is no more possible. In order to overcome this problem, to a transfer charger, an increasing amount of current is applied with each repetition of transfer: 150 μA for Y, 250 for C, 400 for M, for example.

The current cannot be boosted up too much. Local short circuits, damage of drum surface therefrom and reverse transfer phenomenon, wherein the toner is retransferred from the recording sheet to the drum, will occur. Thus, with many (up to 8) transfer processes according to the present invention, it is not easy to reserve sufficient steps for each repetition.

Referring to FIG. *6d*, the characteristic A is more important. The characteristic B only serves to improve the tone reproduction of dark area, while A covers the whole reproduction. It is therefore a preferred embodiment of the present invention to do A first. Even when some decrease in transfer efficiency is inevitable, the demerit is minimized if it occurs when the characteristic B is in progress.

Interim discharge (elimination) during a series of transfer processes is another possible solution of this problem and is incorporated into a preferred embodiment in accordance with the present invention. This must be a partial discharge, otherwise the recording sheet tends to be peeled off out of the transfer drum, resulting in stained images and jammed papers. It is for this reason why an intermediate level alternating voltage (4 kV) is applied to the separation electrodes after the first cycle (or three transfer processes), which is lower than the one necessary to separate the sheet from the drum (5.5 kV). With such an interim discharge, an increase in current applied for transfer charger is possible in sufficient steps to maintain the transfer efficiency.

The image recording device in accordance with the present invention is of electrostatic transfer type. A corona charging device, such as is used for sensitizing, is used most satisfactorily. Use of semiconductive rubber roller may be alternatively employed.

Of the two best known transfer methods for xerography, adhesive transfer is not suitable. During the repetitive transfers, the adhesive may be locally covered with toner and becomes not tacky enough to pick the powder image in the later transfers, because the shadow part overlaps from one image to another.

Figure 2:
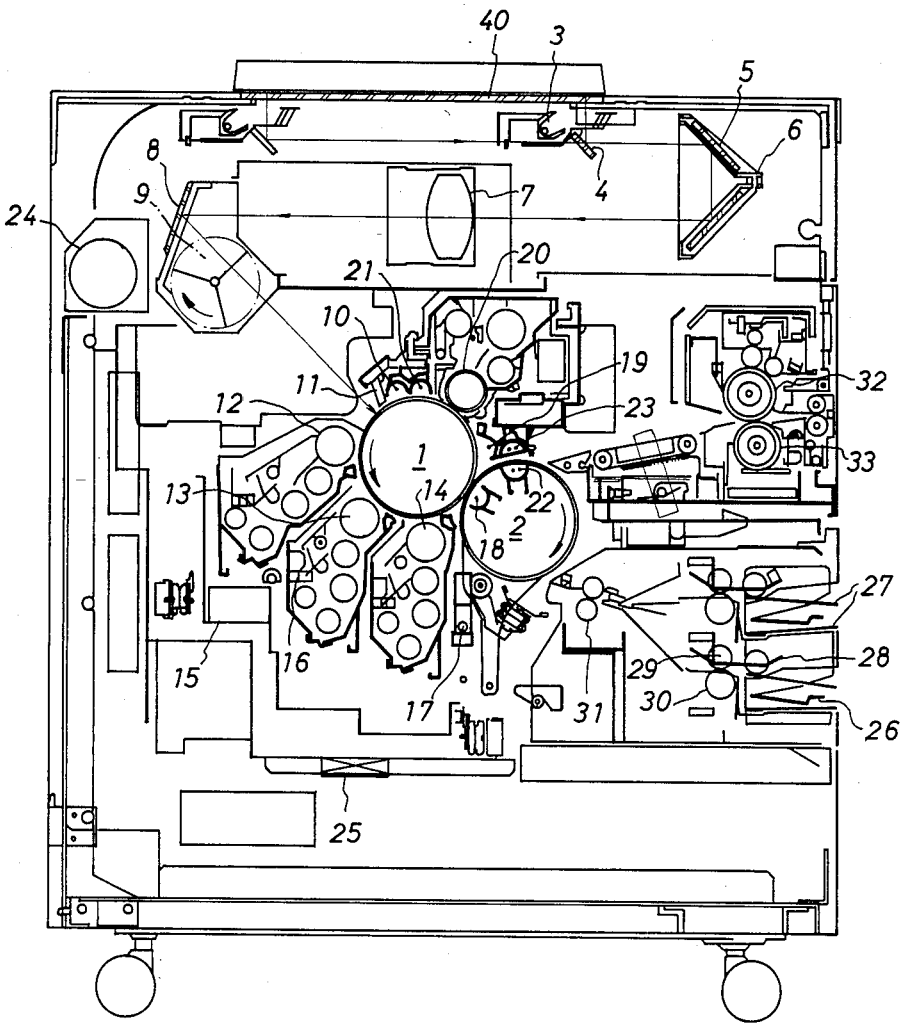
FIG. 2 is a front elevational view showing mechanical structure of the machine in accordance with the present invention.

FIGS. *3a* and *3b* are perspective views showing a portion of the device illustrated in FIG. 2.

FIGS. *4a* and *4b* are plan views illustrating the appearance of the operation board OP1 and the color balance setting board OP2 of the device illustrated in FIG. 2.

FIGS. *5a* (divided into two sections), *5b* (divided into two sections), *5c* (divided into two sections), *5d* (divided into three sections) and *5e* are block diagrams showing the constitution of the electrical circuits for the device illustrated in FIG. 2.

FIGS. *6a*, *6b* and *6c* show how the original-versus-copy density relationship is adjusted when three kinds of parameters (the development bias potential, the amount of exposure and the charge voltage of the photoconductive layer), respectively, are modified; FIG. *6d* illustrates the effect of superimposition to realize better tone reproduction.

Figure 7:
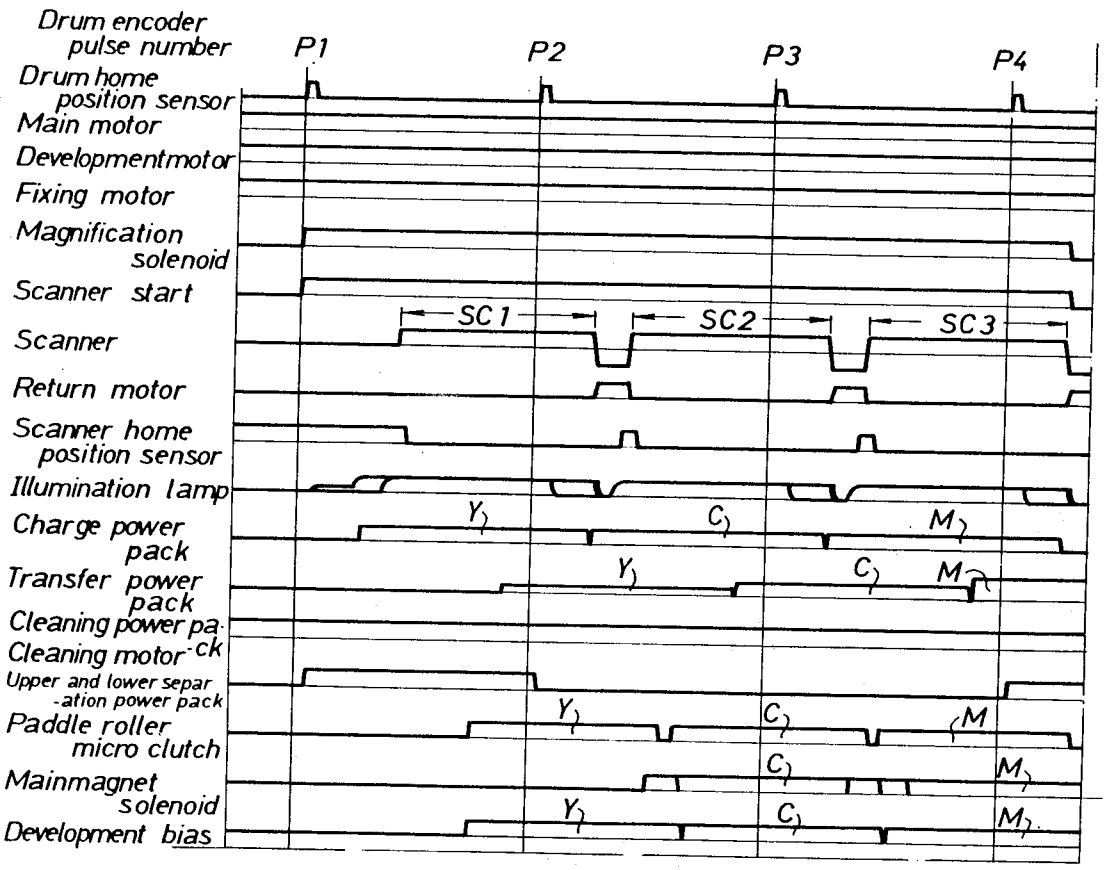

FIG. 7, divided into four sections, is a timing chart showing a preferred embodiment of the present invention when operated in a mode other than Mode D, a single cycled color recording.

Figure 8:
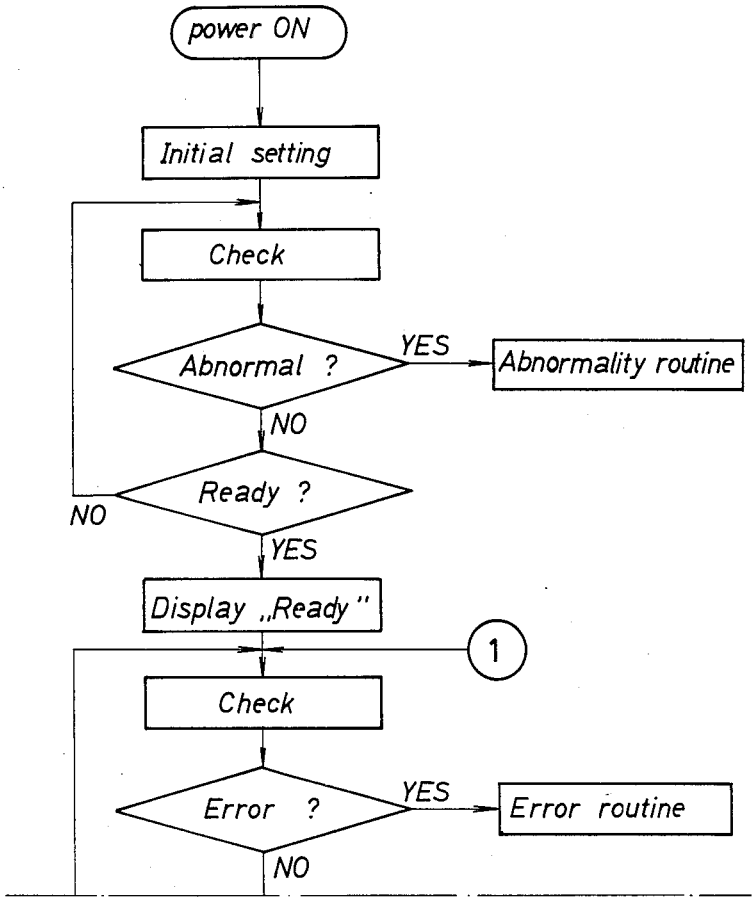

FIGS. 8 (divided into two sections), *9a* (divided into two sections), *9b*, *9c*, *9d* (divided into two sections), *10a*, *10b* (divided into two sections), *10c* (divided into two sections), *10d*, *10e*, *10f* (divided into two sections), *10g* and *10h* are flow charts illustrating the operation of the electrical circuit for the device illustrated in FIG. 2.

FIG. 11 is a memory map showing a portion of allocation for each of the memories in the memory unit 170.

Figure 12:
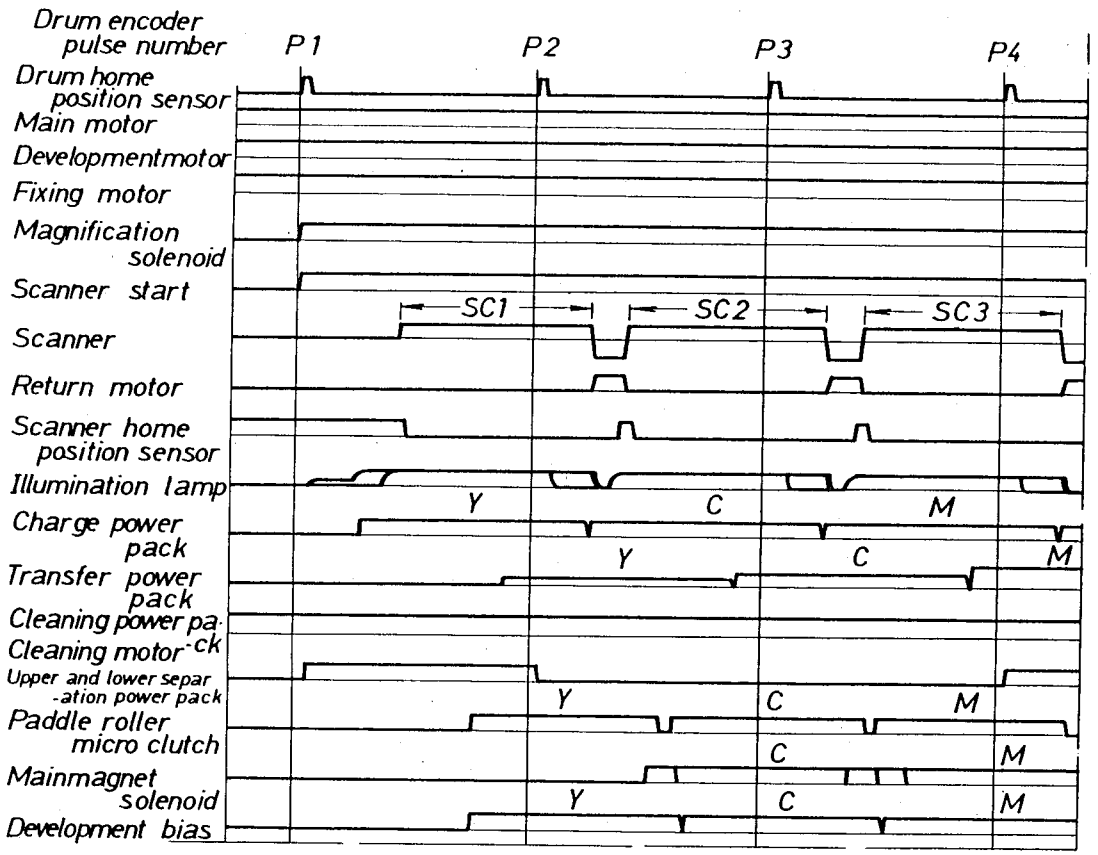

FIG. 12, divided into four sections, is a timing chart showing another preferred embodiment of the present invention when operated in a dual cycled mode, in the second of which the yellow operation is omitted.

DESCRIPTION OF THE PREFERRED EMBODIMENTS

While the image recording device in accordance with the present invention is susceptible of numerous varieties, depending upon the environment and requirements of use, a preferred embodiment of the same has been on sale successfully since the autumn of 1985 as RICOH COLOR 5000, the pet name being "Paradice Bird".

This invention will now be explained in detail referring to the attached drawings.

FIG. 2 shows a mechanical structure of a color copier for practicing this invention. Referring to the same, reference numeral 40 represents contact glass for placing an original document thereon. An optical scanning system is disposed below the contact glass 40, which comprises an illumination lamp 3, a first mirror 4, a second mirror 5, a third mirror 6, a lens 7, a fourth mirror 8, color separation filters 9, etc. Light emitted from the illumination lamp 3 is exposed to an original document (not illustrated) placed on the contact glass 40, and the reflected light reaches to the surface of a photoconductive drum 1, while passing through the first mirror 4, the second mirror 5, the third mirror 6, the lens 7, the fourth mirror 8 and the color separation filters 9 in the process.

The color separation filters 9 comprise three filter plates of R (red), G (green) and B (blue) disposed at an angle of 120° with each other, of which one is selectively inserted into the path of the optical scanning system. The selection is made by driving a filter motor M5 described later. With the respective filter plates R, G and B being successively inserted into the path, the document is scanned to obtain original images separated into each of primary colors R, G and B. In this embodiment, the filter plates are selected in the order of B, R and G. A home position sensor (described later as SE5)

detects whether the blue filter plate is inserted in the path or not.

Close to the surface of the photoconductive drum 1 (charge support means), are disposed an electrical charger (main charger) 10, an eraser 11, a magenta (M) development roller 12, a cyan (C) development roller 13, a yellow (Y) development roller 14, a transfer drum 2, a transfer charger 18, a pre-cleaning charge elimination charger 19, a cleaning unit 20, a charge elimination charger 21, etc.

In FIG. 2, the photoconductive drum 1 rotates counterclockwise, while the transfer drum 2 rotates clockwise. The transfer charger 18 is placed inside the transfer drum 2, in close vicinity to the photoconductive drum 1. The cylindrical portion of the transfer drum 2 for holding a recording sheet comprises a dielectric film, which is in contact with the surface of the photoconductive drum 1 by way of the recording sheet. Two separation chargers 22 and 23 are disposed at a position downstream to the transfer charger 18 of the transfer drum 2 so as to sandwitch the wall of the transfer drum 2 therebetween.

Figure 3B:
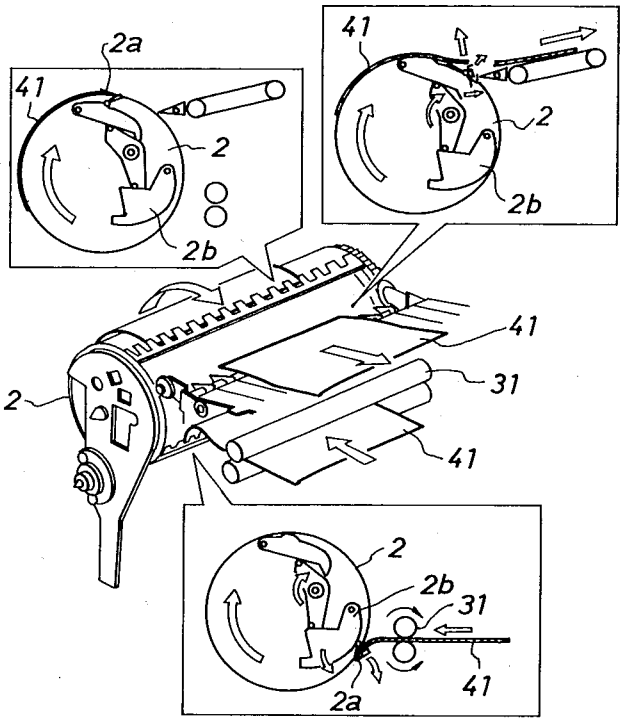

A paper feed system comprises two cassettes 26 and 27, one of which is to be selected. The lower one comprises a pick up roller 28, a feed roller 29 and a reverse roller 30, and, by the action of these, recording sheets are fed one by one from the cassette 26. The upper one is constituted in the same manner. A recording sheet 41 fed from the cassette (upper or lower) temporarily stops at a position of a resist roller 31 and then is sent to the transfer drum 2 in synchronization with the rotating timing of the transfer drum 2 as shown in FIG. 3*b*.

The transfer drum 2 has at its surface a clamp plate 2*a* in parallel with the rotating axis thereof. The clamp plate 2*a* is normally closed and put to open and closure by a cam mechanism 2*b* driven by a motor M7 described later. Specifically, the clamp plate 2*a* is opened upon feeding the recording sheet 41 and the plate is closed when the recording sheet 41 enters between the clamp plate 2*a* and transfer drum 2 to hold the leading end of the recording sheet 41. Due to the potential of the transfer drum 2 accumulated by the supply of a transfer current, an electrostatic attraction is exerted to thereby further hold the recording sheet 41 on the transfer drum.

When all of the image transfers are over, the charge is eliminated by applying a predetermined AC voltage to the separation chargers 22 and 23 and, simultaneously, the clamp plate 2*a* is opened to release the recording sheet 41 from the transfer drum 2.

Figure 3A:
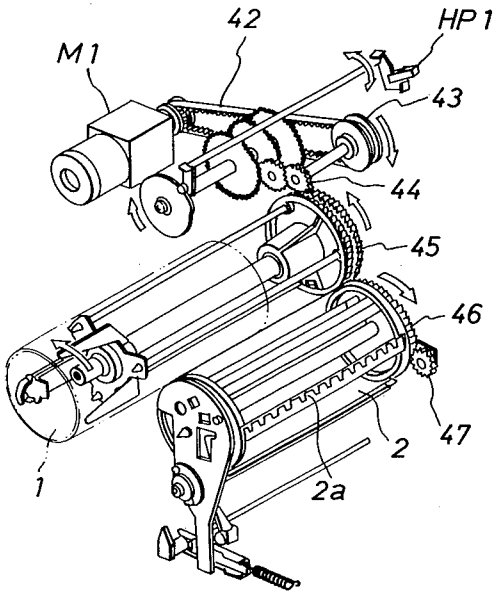

As shown in FIG. 3*a*, the photoconductive drum 1 and the transfer drum 2 are engaged with each other by means of gears 45 and 46, in which the gear 45 is connected by way of a transmission mechanism 42 to a main motor M1. The transmission mechanism 42 comprises a home position sensor HP1.

Referring again to FIG. 2, the recording sheet is separated from the transfer drum 2 passing through the gap between the separation chargers 22 and 23, heat-fixed when it passes between a fixing roller 32 and a pressure roller 33 disposed downstream to the transfer drum 2 and then discharged.

Figure 4A:
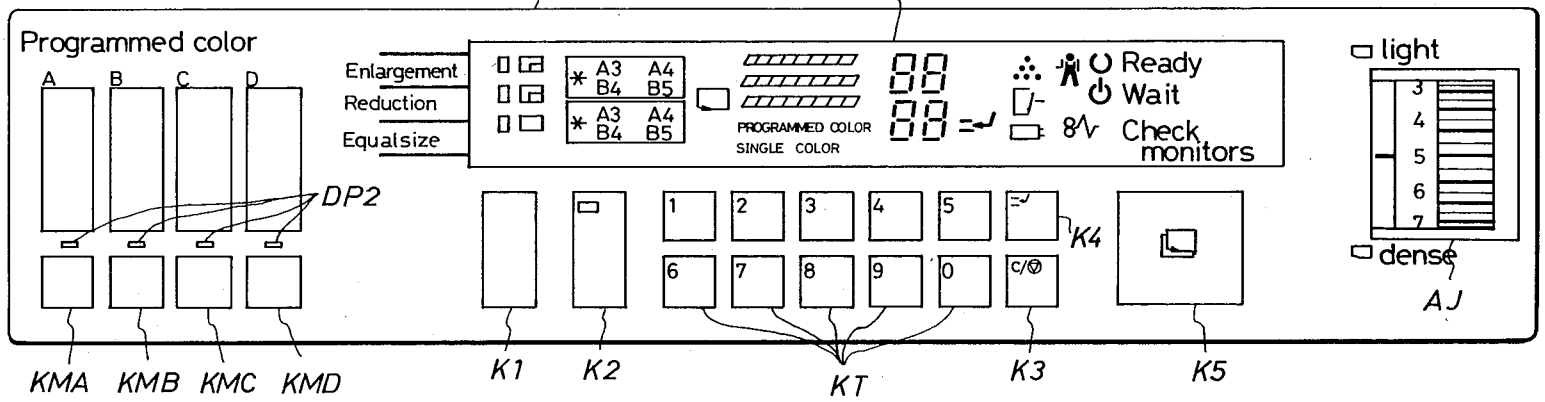

An operation board OP1 for the color copier shown in FIG. 2 is illustrated in FIG. 4*a*. Referring to FIG. 4*a*, the operation board comprises a display DP1, a ten key KT, a magnification key K1, a sheet size key K2, a clear-stop key K3, an interruption key K4, a print key K5, a density control knob AJ, operation mode selection keys KMA, KMB, KMC and KMD and a mode display DP2.

In this embodiment, a copying process can be executed with five kinds of predetermined density characteristics by manipulating the operation mode selection keys KMA, KMB, KMC and KMD. During the initialization process for the device, the normal mode (or first mode) is automatically selected by default and then A mode (second mode), B mode (third mode), C mode (fourth mode) and D mode (fifth mode) are selected only when the operation mode selection keys KMA, KMB, KMC and KMD are touched, respectively.

Figure 4B:
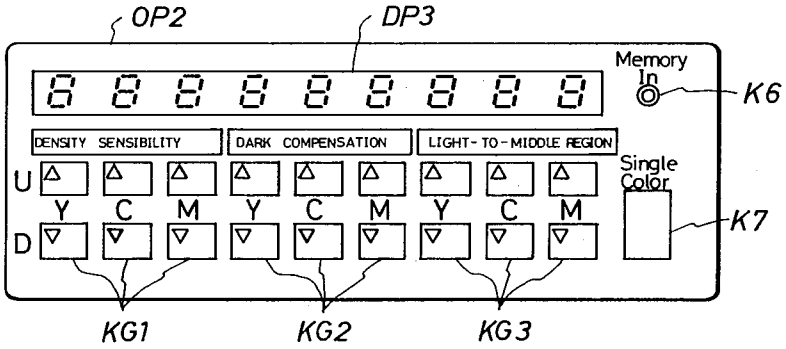

For setting the characteristics for each of the modes, the color copier comprises a color balance setting board OP2 as shown in FIG. 4*b*. The setting board OP2 is situated near the operation board OP1 and usually closed by a cover not illustrated.

Referring to FIG. 4*b*, the color balance setting board OP2 comprises a plurality of keys and a display DP3. Six keys KG1 are for the control (up-down) of the development bias potential for each of the colors Y, C and M, six keys KG2 are for the control of the charge voltage to the main charger 10 for each of the colors Y, C and M and six keys KG3 are for the control for the illumination lamp 3 for each of the colors Y, C and M. A key K6 is a memory-in-key for accommodating the updated values by the keys KG1, KG2 and KG3 into a memory of a designated mode and a key K7, in this particular example, is a key for selecting the full color mode and the monochrome mode.

The display DP3 comprises nine 7-segment numerical displays, in which one display digit is allocated to each one of 9 parameters, that is, Y, C and M for the development bias, Y, C and M for the main charger voltage and Y, C and M for the exposure level. Since each of the display digits can display 0, 1, 2, 3, 4, 5, 6, 7, 8, 9, A, B, C, D, E and F, display at 16 steps can be made for each of the nine parameters. That is, each of the parameters can be modified in 16 steps of levels in this color balance setting board OP2.

FIGS. 5*a*, 5*b*, 5*c*, 5*d* and 5*e* show the schematic constitution of an electrical circuit in the color copier shown in FIG. 2. Referring to each of the figures, a main control board 100 controls the entire device, to which sensors, motors, solenoids, etc. are connected by way of various types of units.

Figure 5A:
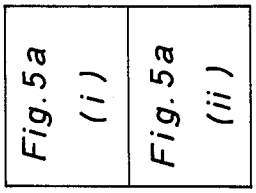
Figure 5A:
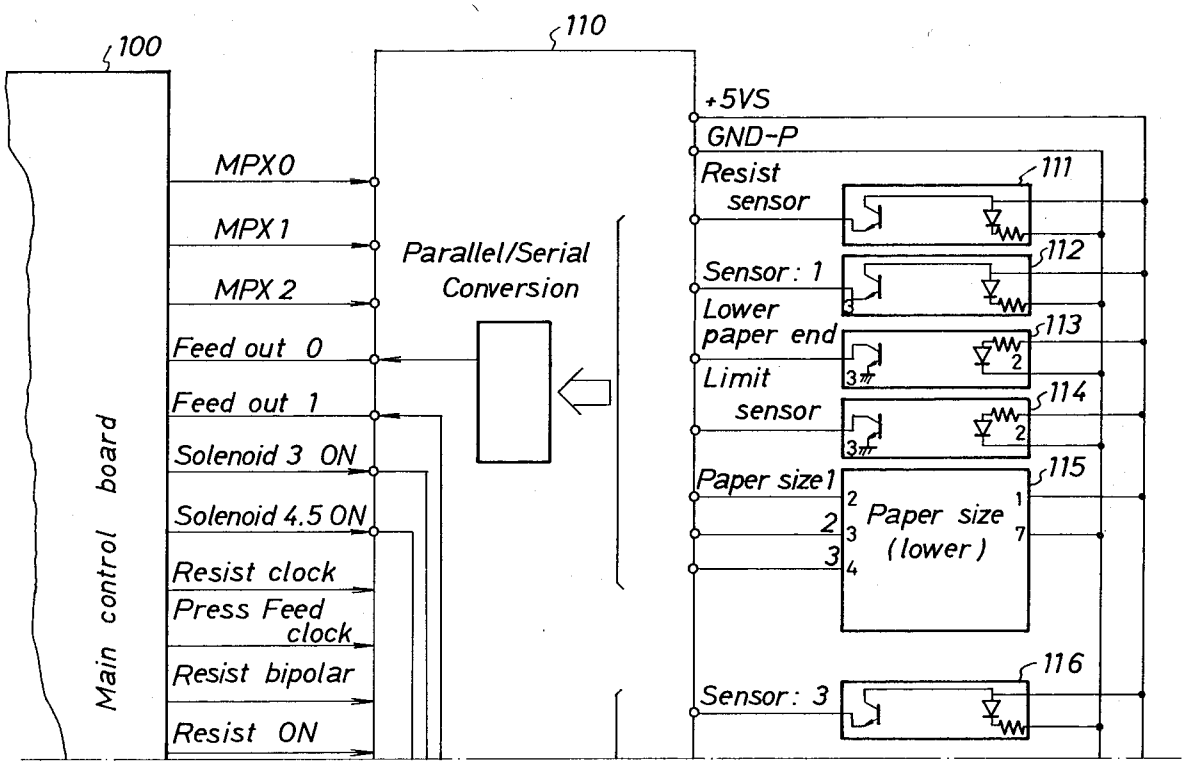

Referring at first to FIG. 5*a*, a paper feed unit 110 is connected to the main control board 100. The paper feed unit 110 is connected with a group of sensors including a resist sensor 111, a paper end sensors 113 and 118, limit position sensors 114 and 119, and paper size sensors 115 and 120, etc., as well as a paper feed stop solenoid SOL3, pick up solenoids SOL4 and SOL5, a resist motor M2, a feed motor M3 and a tray lift motor (for pressurizing) M4.

Figure 5B:
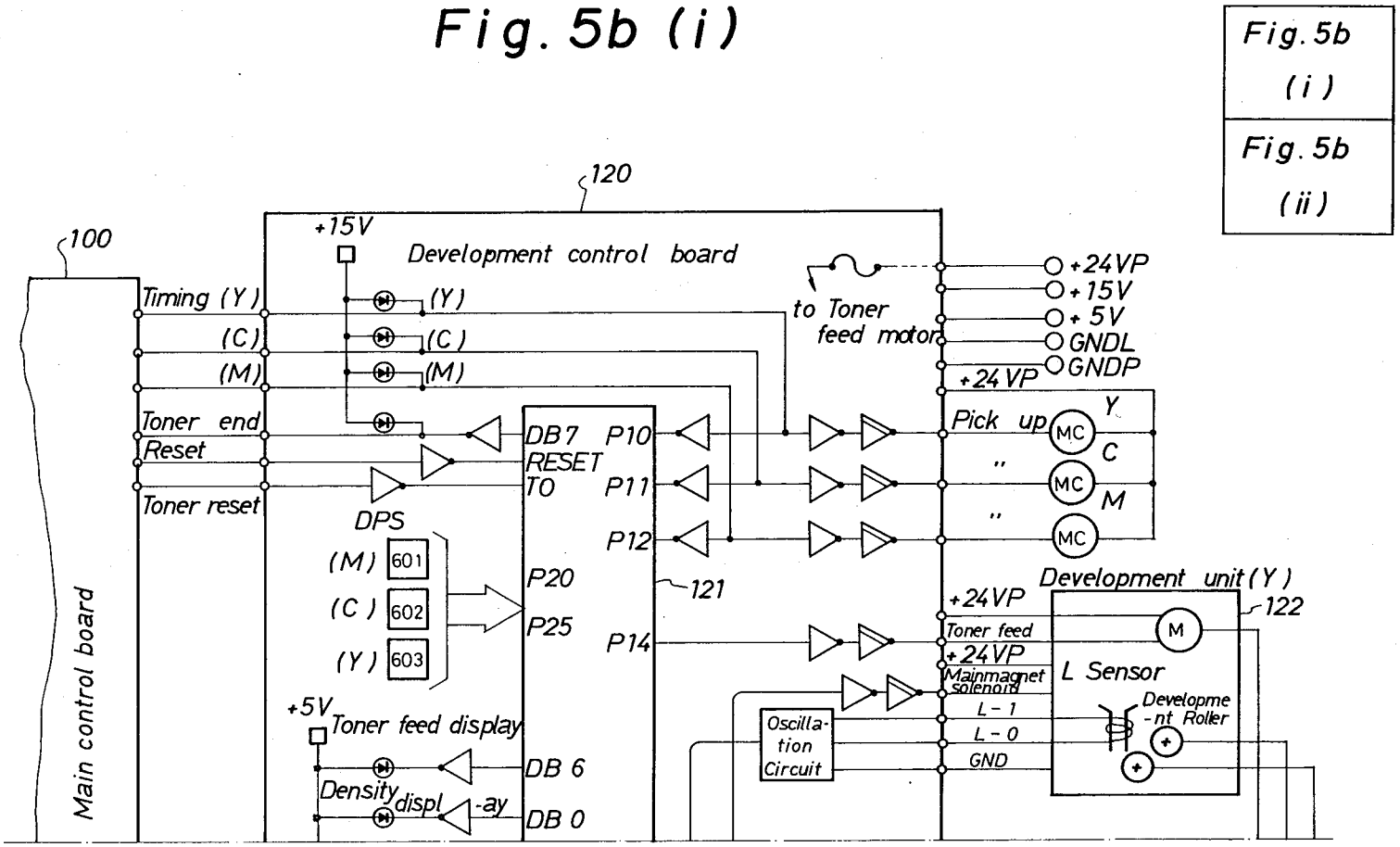

Then, referring to FIG. 5*b*, the main control board 100 is connected with a development control board 120. The development control board 120 is connected with development units 122, 123 and 124 for the colors Y, C and M, respectively, as well as various clutches. The development control board 120 incorporates a microcomputer 121 for automatically controlling the toner density in each of the development units. The development roller and the puddle roller in each of the development units is connected with power output lines B-S and B-D from a high voltage power source unit 130 shown in FIG. 5*c*.

Figure 5C:
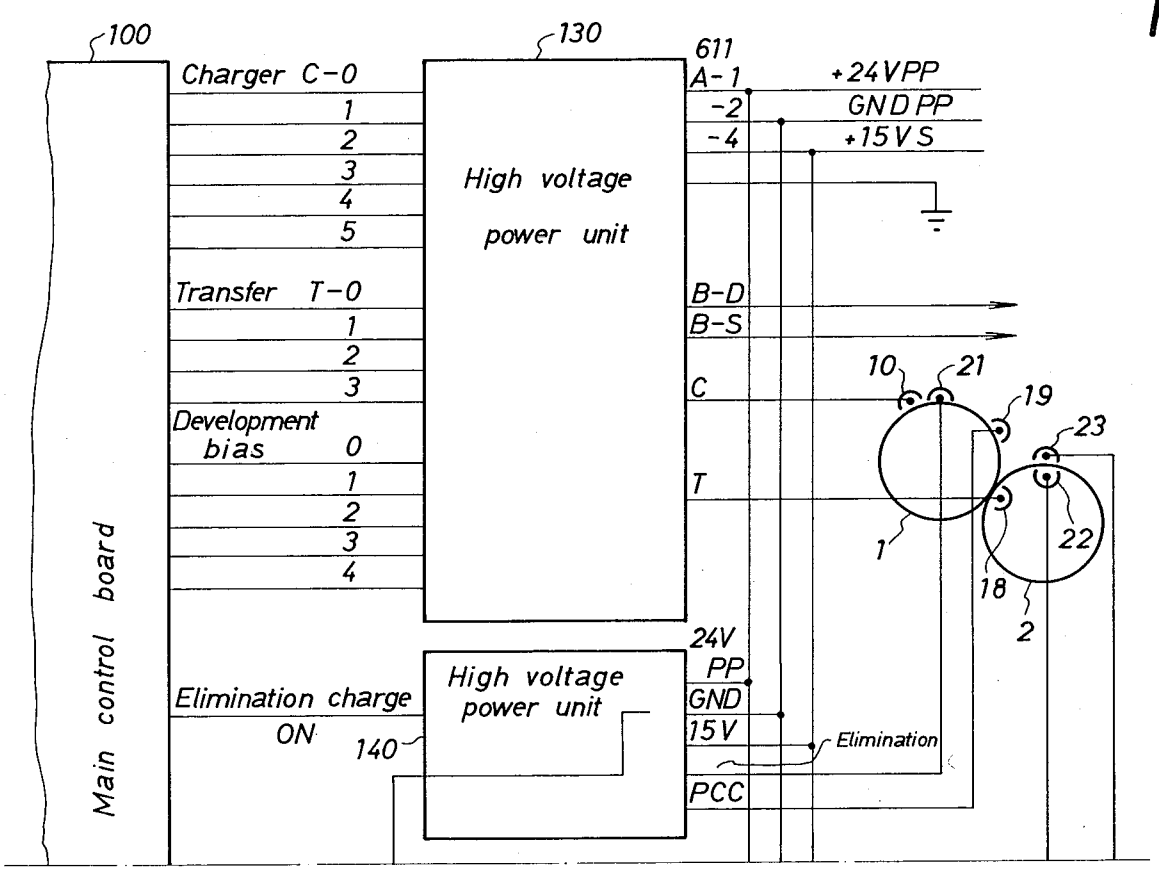

Referring to FIG. 5c, the main control board 100 is connected with high voltage power source units 130, 140 and 150 and an eraser 11. The high voltage power source unit 130 supplies a predetermined electric power to a charger voltage output C, a transfer current output T, and development bias potential outputs B-D and B-S, respectively, in response to 6 bit charge control signal, 4 bit transfer control signal and 5 bit development bias control signal from the main control board 100. The charger voltage output C from the high voltage power unit 130 is connected to the main charger 10 and the transfer current output T is connected to the transfer charger 18.

When a charge elimination charger ON signal from the main control board 100 is turned on, the high voltage power source unit 140 applies a predetermined charge elimination voltage to the charge elimination chargers 19 and 21. The high voltage power source unit 150 applies a predetermined separation voltage between the separation chargers 22 and 23 when a separation charger ON signal from the main control board 100 is turned on. In this embodiment, the separation charger ON signal comprises 2 bits and the separation voltage is capable of switching between AC 5.5 KV and AC 4 KV. In the case of applying 4 KV voltage, the recording sheet does not detatch from the transfer drum since no sufficient charge elimination is conducted.

Figure 5D:
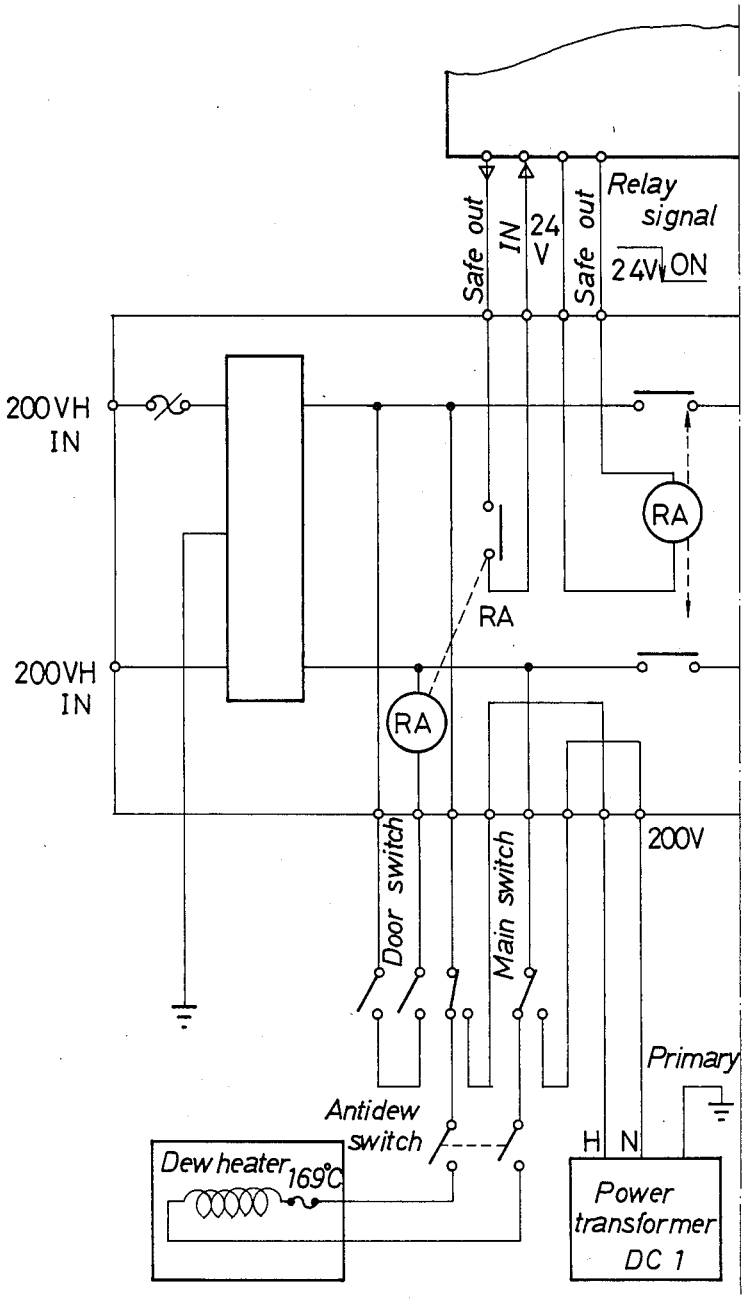
Figure 5D:
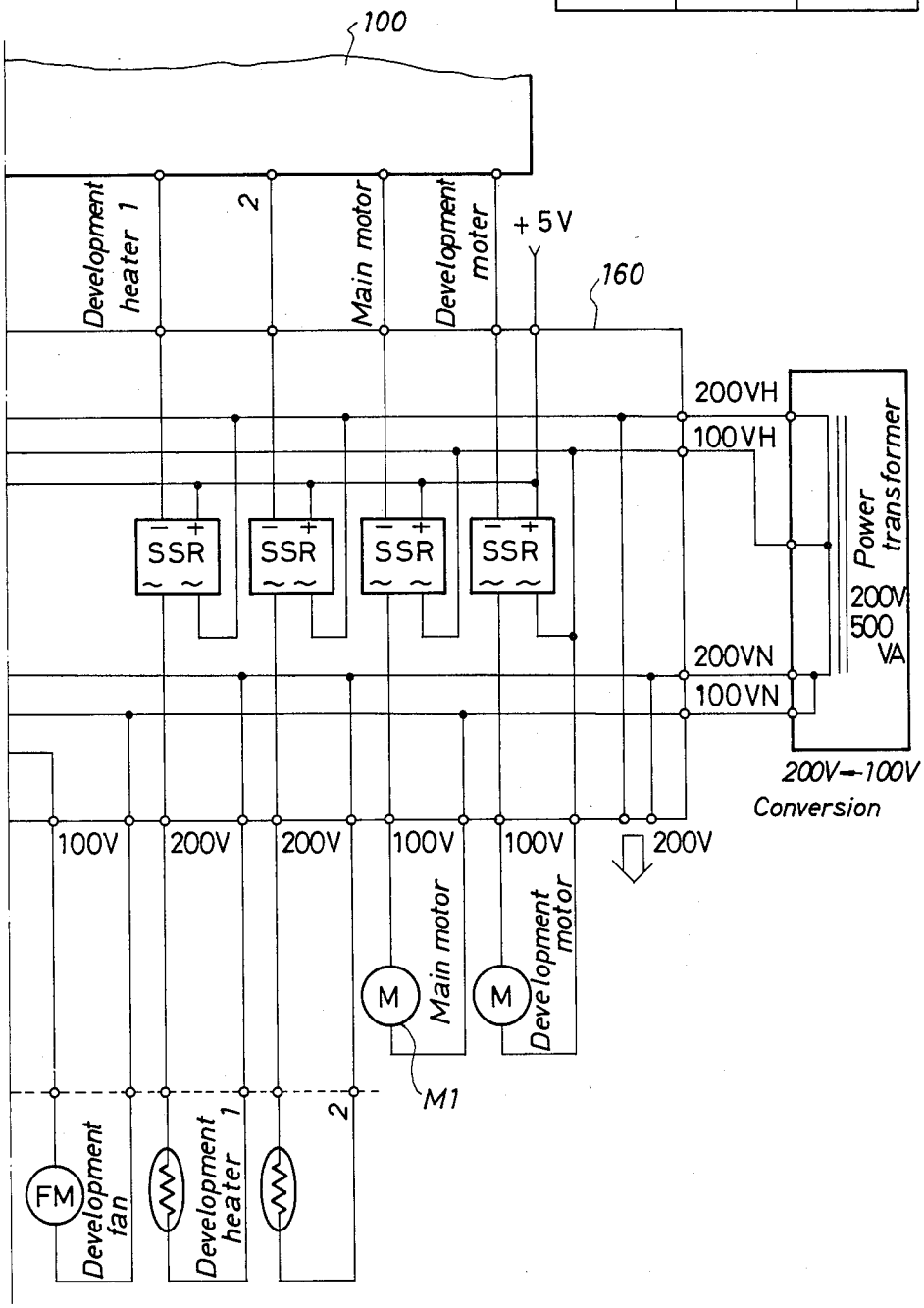

Referring to FIG. 5d, the main control board 100 is connected with an AC power source unit 160. The AC power source unit 160 performs voltage conversion, switching for the AC power, etc. The AC power source unit 160 is connected with a lamp regulator, a development motor, a main motor M1, fixing heaters, a fixing fan, a fixing drive motor, power transformers, etc. The AC power source unit 160 incorporates filters, relays and a number of solid-state relays.

Figure 5E:
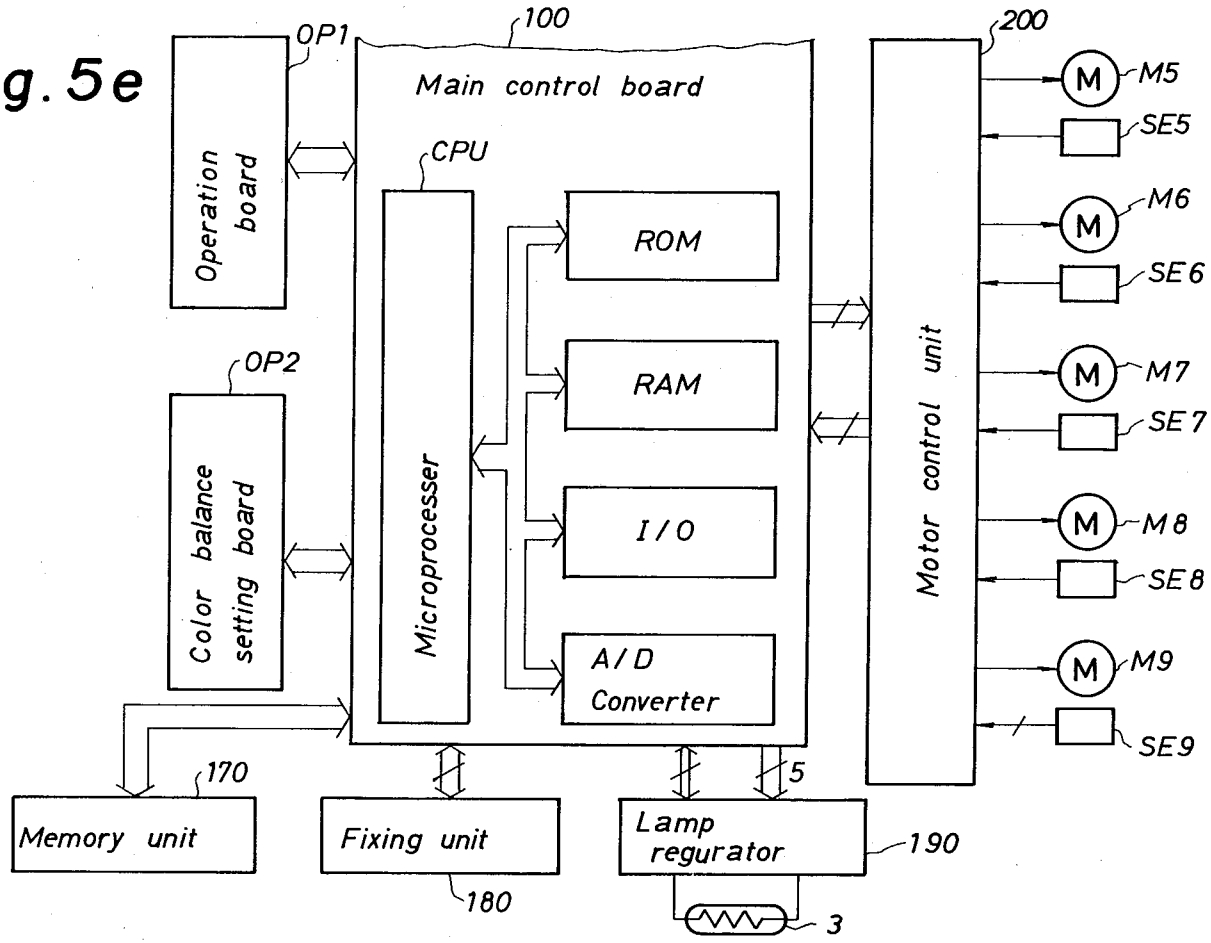

Referring to FIG. 5e, the main control board 100 is connected with an operation board OP1, a color balance setting board OP2, a memory unit 170, a fixing unit 180, a lamp regulator 190 and a motor control unit 200. In this embodiment, it is adapted such that the light illumination level of the lamp regulator 190 is set by a 5 bit control signal from the main control board 100.

The motor control unit 200 is connected with a filter motor M5, a lens motor M6, a clamp motor M7, a return motor M8 and a cleaning motor M9, as well as sensors SE5, SE6, SE7, SE8 and SE9 for detecting home positions of mechanisms driven by the respective motors. The filter motor M5 drives the color separation filters 9, the lens motor M6 drives the lens 7 to change the magnification, the clamp motor M7 conducts ON-OFF drive for the clamp plate 2a, the return motor M8 conducts the return drive for the optical scanner system and the cleaning motor M9 drives the cleaning unit 20. The main control board 100 incorporates a microprocessor, a ROM (read only memory), a RAM (random access memory), I/O, A/D converters, etc. The memory unit 170 comprises a battery back-up circuit which stores the data, for example, standard values of various parameters set by the color balance setting board OP2, necessary even after the power is shut off.

The operation of the color copier shown in FIG. 2 is explained, a characteristic portion thereof being briefly explained at first. In this embodiment, the image-forming and transfer processes are carried out each by once for the respective colors Y, C and M under the normal default mode, Mode A, Mode B and Mode C (single color modes). However, if the Mode D is selected by touching the operation mode key KMD, each of the image-forming and transfer processes for the respective colors Y, C and M is conducted for once in accordance with the characteristics under the Mode B and, thereafter, each one for the respective colors Y, C and M is conducted for once in accordance with the characteristics under the Mode C. That is, the image-formation and transfer are carried out for six times in the Mode D (full color mode).

Figure 6B:
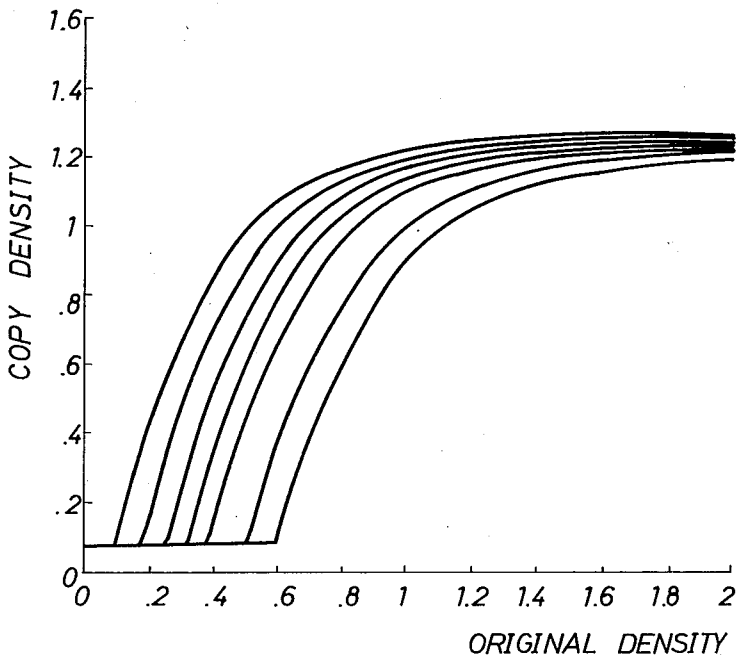
Figure 6A:
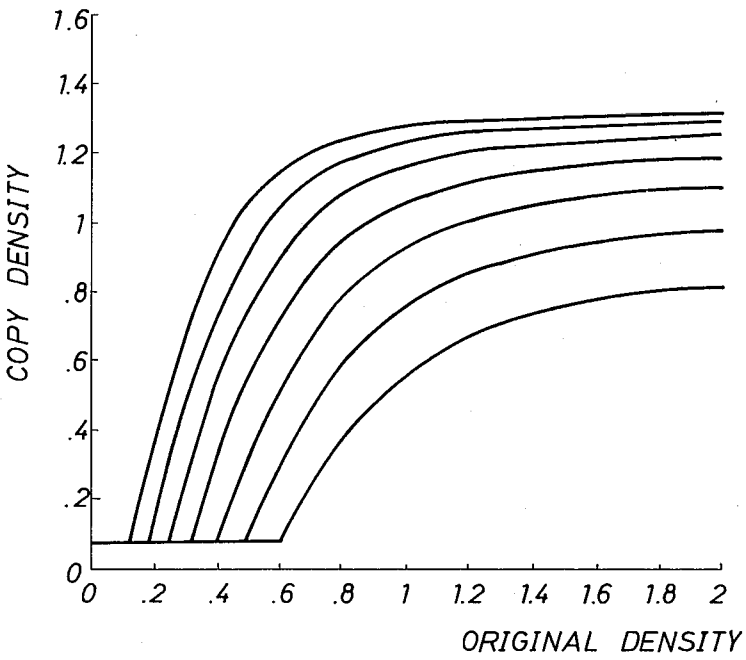
Figure 6D:
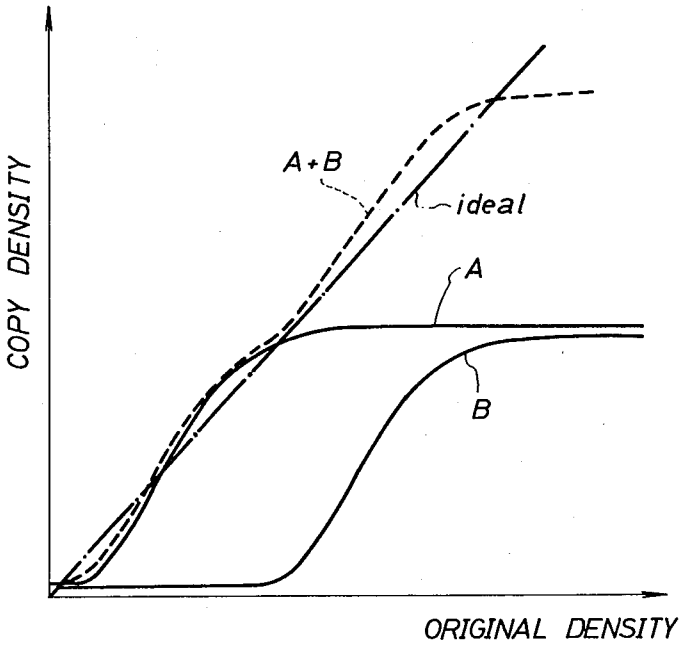
Figure 6C:
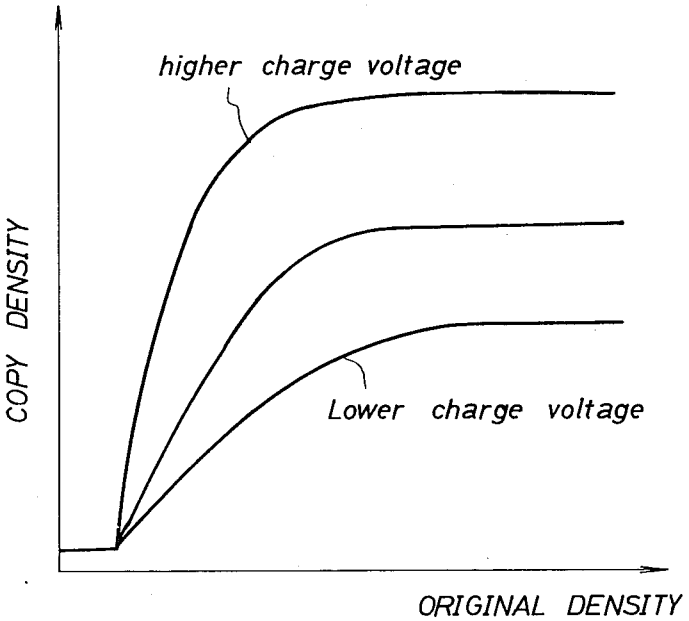

Accordingly, by setting the characteristic A to the Mode B and characteristic B to the Mode C, each characteristic being illustrated in FIG. 6d, recording can be conducted with the summed up characteristic A+B by selecting the Mode D.

FIG. 8 shows the schematic operation of the copier shown in FIG. 2. Referring to the same, when the power source is turned on, initialization procedure is made at first. Specifically, after setting the output port to the initial state and clearing the internal memory, positions for the movable portions such as a scanner, a magnification mechanism, color separation filters, etc. are set to the initial state (home position) and each of the process control units is brought to a ready state. A normal mode is selected by default for the operation mode. In the normal mode, all of the displays DP2 on the operation board OP1 are extinguished.

After the initialization, each of the portions (fixing temperature, etc.) are repeatedly checked until they reach "Ready" status. If there is any abnormality, the step is proceeded to the abnormality routine. Otherwise, "Ready" is indicated at the display DP1 on the operation board OP1, while procedures such as error check, key input subroutine, display processing for each of the portions are executed repeatedly till the print key K5 is depressed.

Figure 9A:
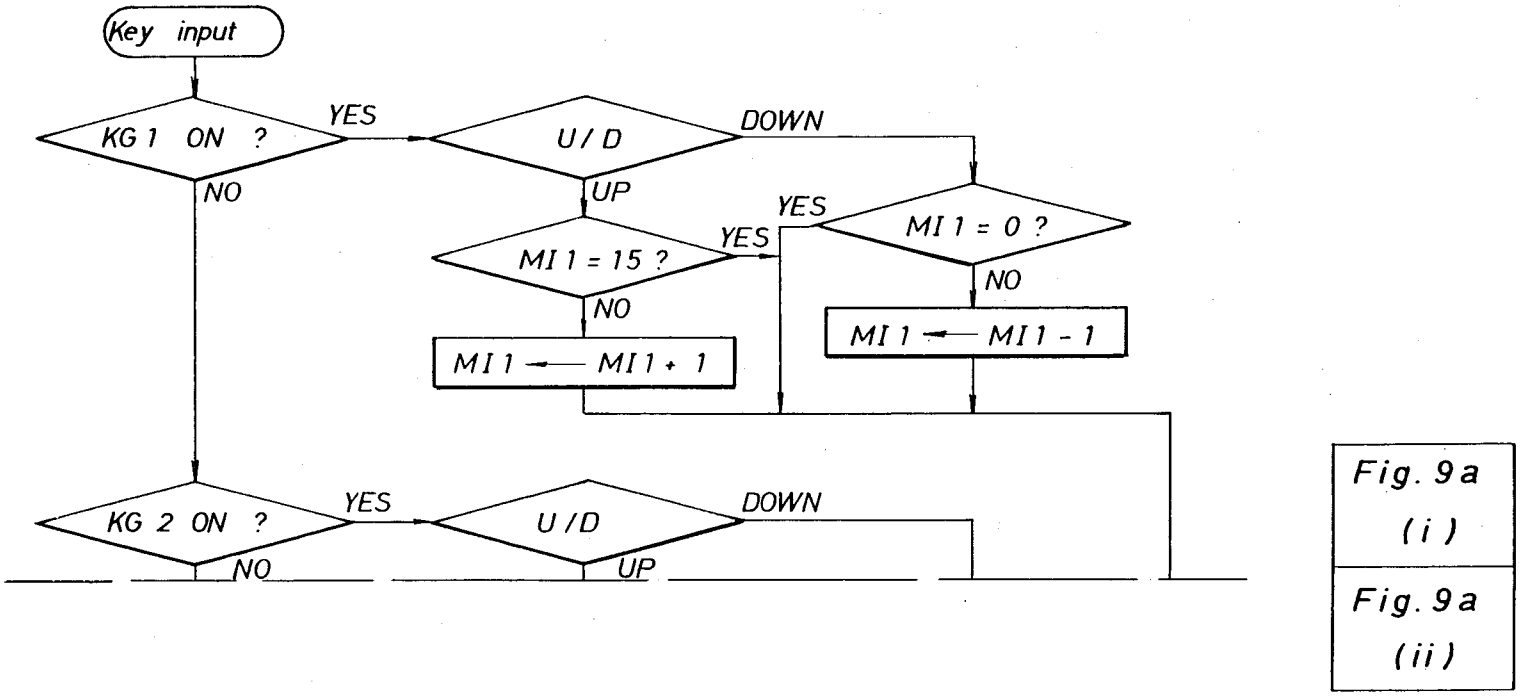
Figure 9A:
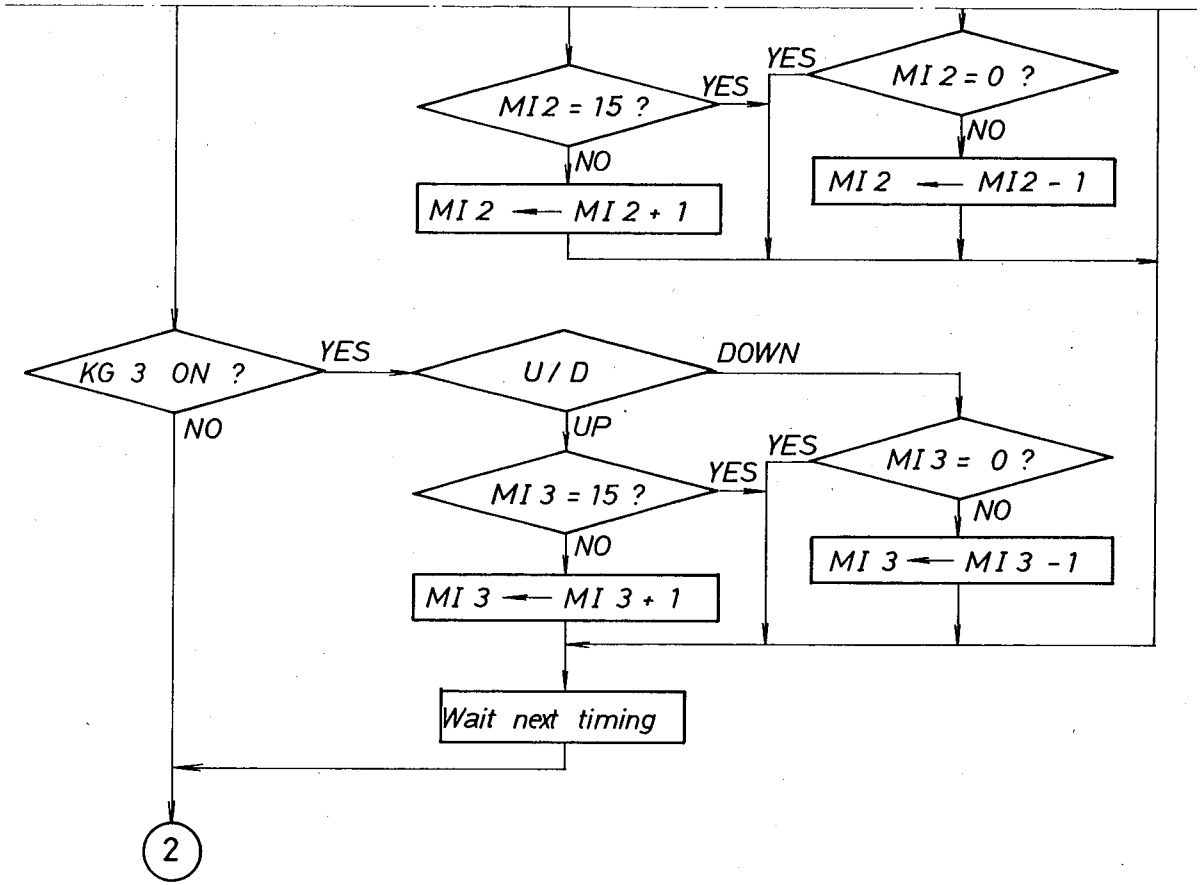
Figure 9B:
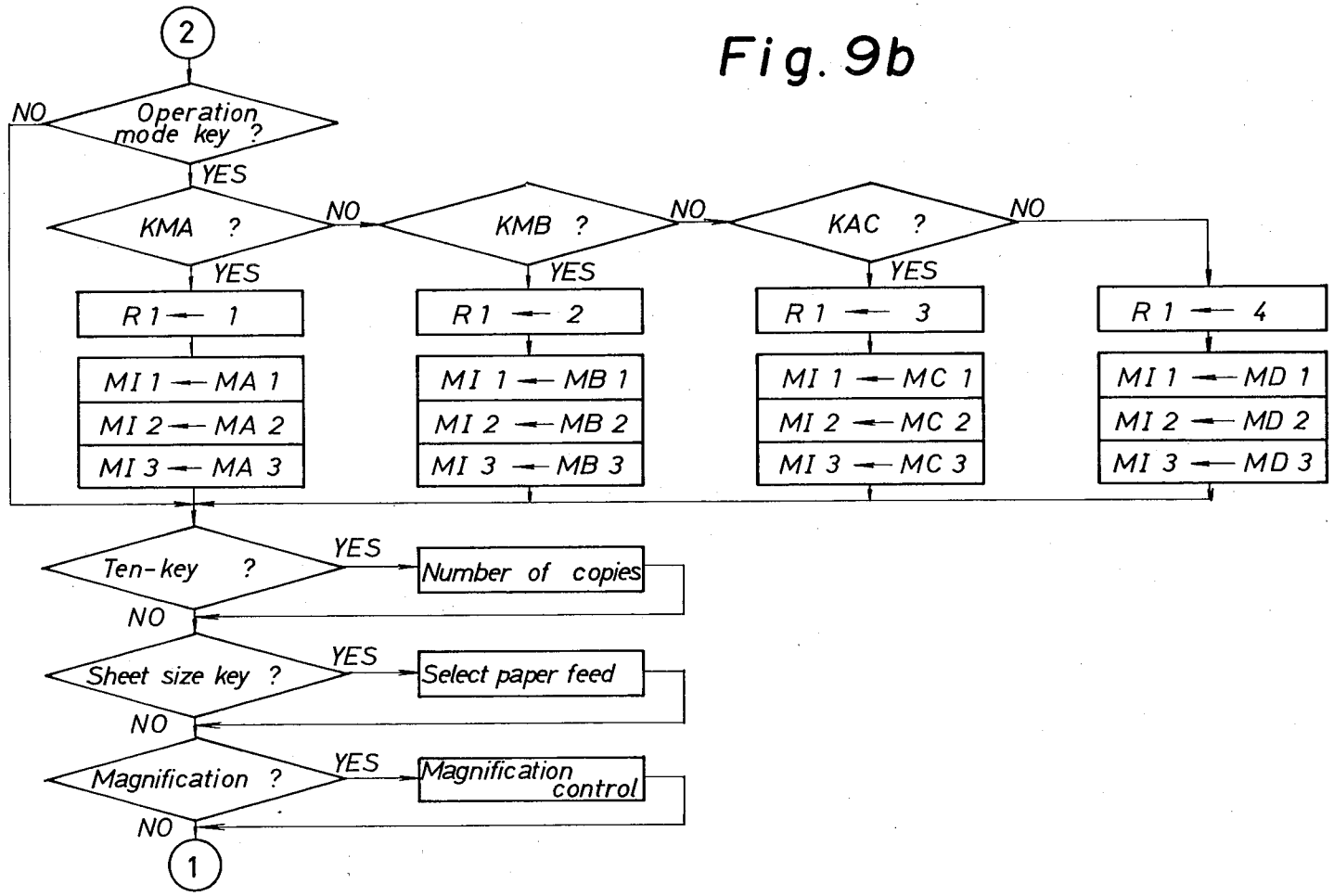
Figure 9C:
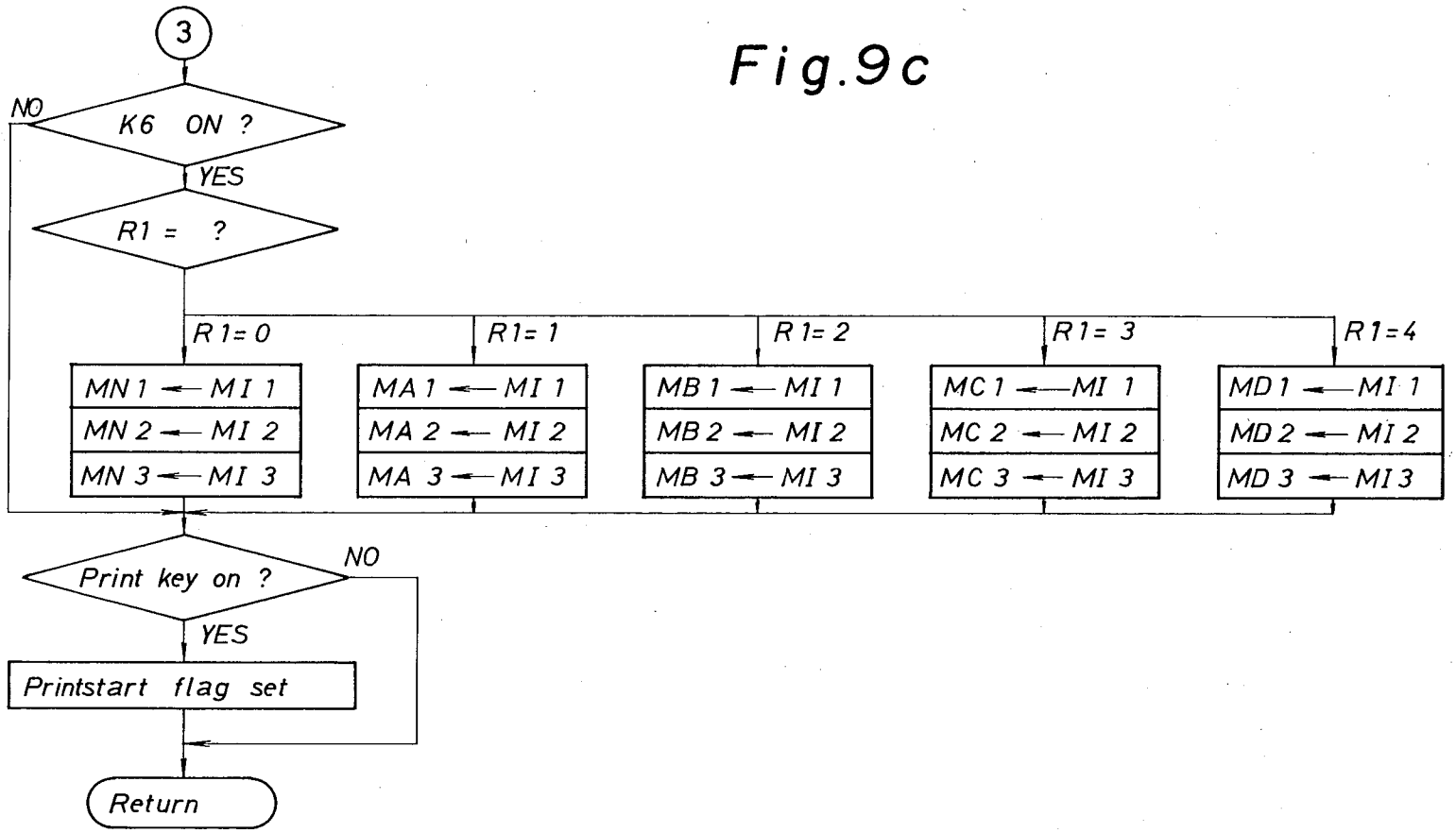
Figure 9D:
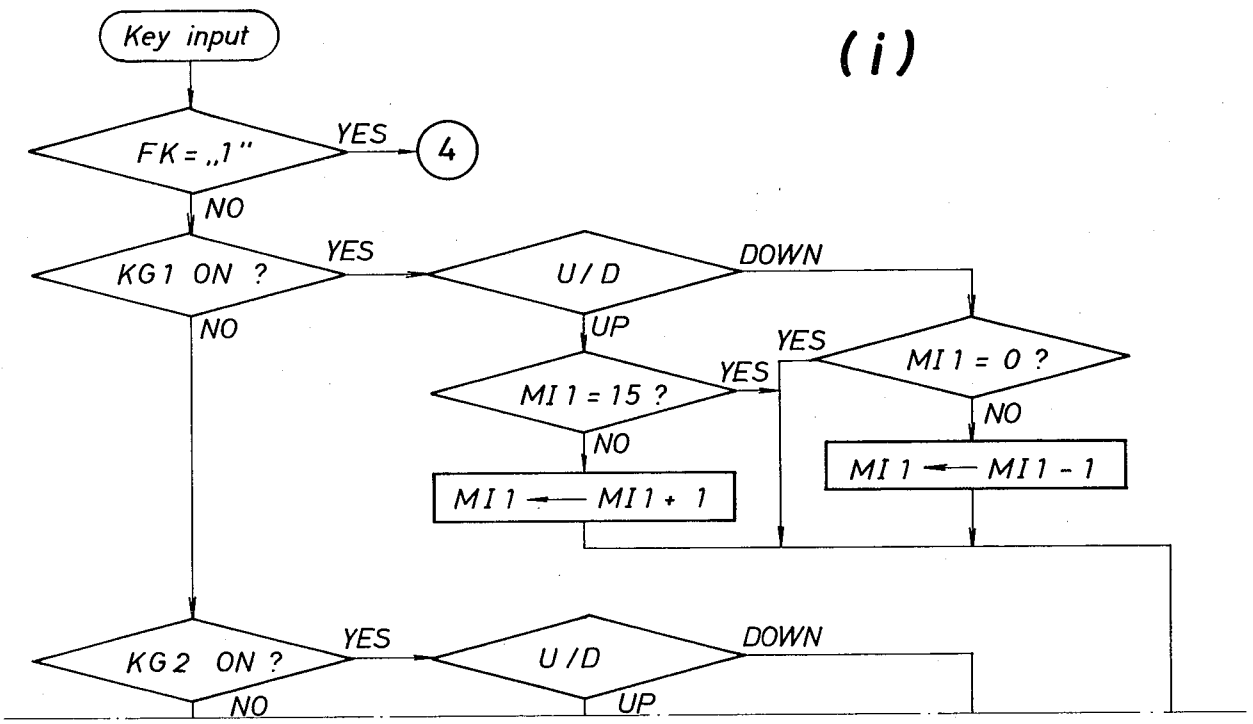
Figure 9D:
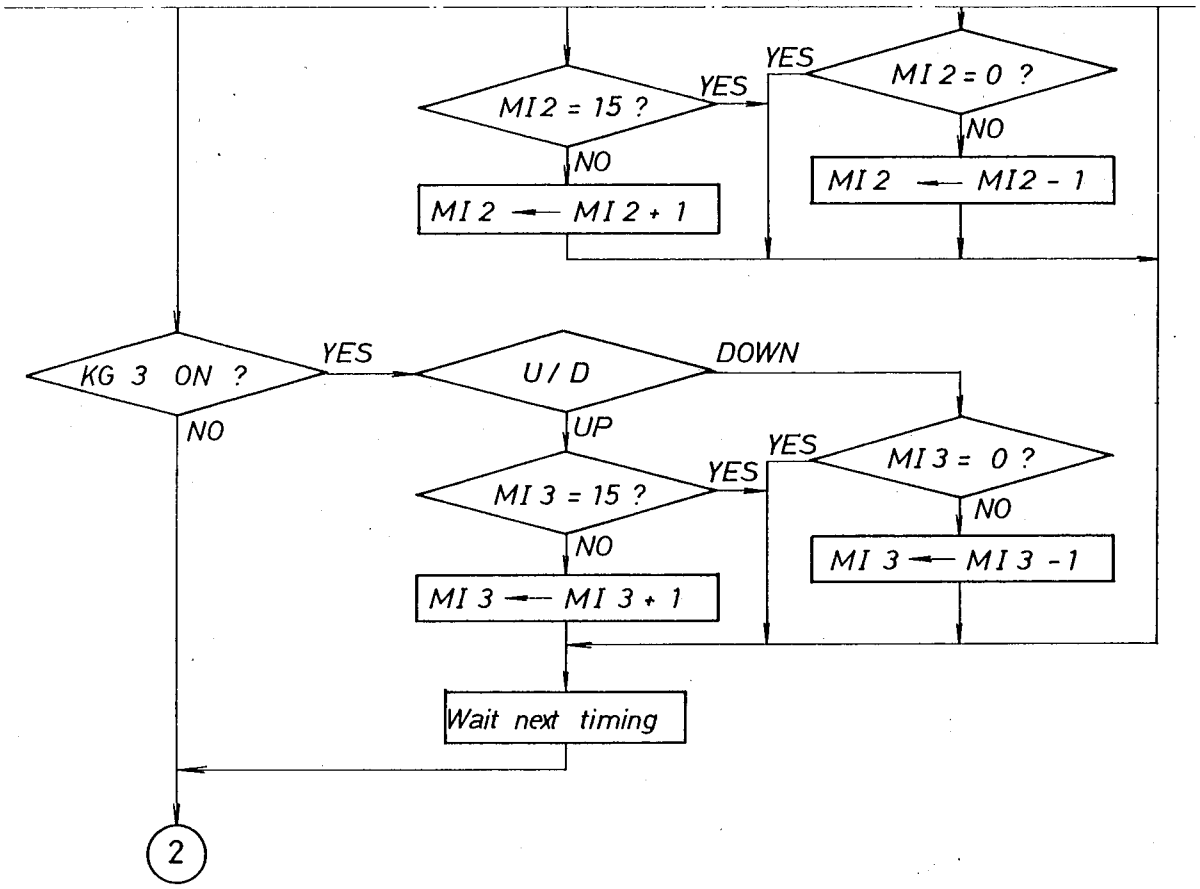

The key input subroutine is shown in FIGS. 9a, 9b and 9c. In this subroutine, absence or presence of the key input is checked and, if there is any, corresponding processing is conducted.

When the ten key KT is turned on, a copy number is set in accordance with numerical value allocated to the relevant key. When the sheet size key K2 is turned on, the feed system is switched from upper to lower or from lower to upper. When the magnification key K1 is turned on, the proper magnification is selected. When the print key K5 is turned on, the print start flag is set.

Prior to the explanation for the key processing relevant to the density parameter, constitution of the memory for accommodating each of the parameters (a portion of the memory unit 170) will be explained. FIG. 11 shows the memory map of the portion. Referring to FIG. 11, memories MI1, MI2, MI3, MN1, MN2, MN3, MA1, MA2, MA3, MB1, MB2, MB3, MC1, MC2, MC3, MD1, MD2 and MD3 are disposed in the memory block corresponding to the colors Y, C and M, respectively. While the memory MIn (n=1-3) stores the data being input, MNn, MAn, MBn, MCn and MDn store the data for the normal default mode, Mode A, Mode B, Mode C and Mode D, respectively. The data stored in each of the regions n=1, n=2 and n=3 in the memories MIn, MNn, MAn, MBn, MCn and MDn, respectively, correspond to the development bias potential, the charge voltage to the main charger and the exposure amount.

FIGS. 9a, 9b and 9c being referred to again, when the key KG1 (any one of six keys) is turned on, judgement is at first made if it is on the up (U) or down (D) side. If it is U, the content of the memory MI1 (only corresponding to the turned-on key among Y, C, M) is incremented (+1). However, if the content before the updating is 15, this maximum value is maintained. On the other hand, if it is D, the content of the memory MI1 (corresponding only to the turned-on key among Y, C, M) is decremented (−1). However, if the content before the updating is "0", this minimum value is maintained.

When the key KG2 (any one of six keys) is turned on, likewise, the content of the memory MI2 is updated. The same is true with the key KG3, except that the content of the memory MI3 is updated.

In the case when the keys for the KG1, KG2 and KG3 are kept depressed, waiting is conducted for a predetermined time after every increment or decrement for the content of the memory. Accordingly, if the keys for the KG1, KG2 and KG3 are being depressed, the value for the memory MIn is repeatedly updated at a step "1" for each predetermined time. The change is within a range from 0–15.

When the memory-in-key K6 is turned on, the content of the mode register R1 is referred to and the processing is effected in accordance therewith. The value corresponds to the operation mode: 0, 1, 2, 3 and 4 correspond respectively to the normal default mode, Mode A, Mode B, Mode C and Mode D. The contents of the memories MIn are stored in the memories MNn, MAn, MBn, MCn and MDn, respectively, in accordance with the valid operation mode.

The memories MNn, MAn, MBn, MCn and MDn store only digital integer data ranging from 0–15. Each one of the integer is associated with an analog data actually employed in the operation. The number of steps (16) may be increased with a built-in switch means, by which a 16-step range can be selected out of a larger-step one.

When the operation mode key is turned on, the following processings are carried out in accordance with the depressed operation mode key. If the operation mode key KMA is depressed, "1" is set to the mode register R1 and the contents of the memories MA1, MA2 and MA3 are stored to the memories MI1, MI2 and MI3, respectively. Other processes will be apparent referring to FIG. 9*b*.

Specifically, if an operation mode is selected by the operation mode keys KMA, KMB, KMC or KMD, parameters of the selected mode are transferred to the memory MIn, and the content of the memory MIn can be updated by the operation of the keys KG1, KG2 and KG3. When the memory-in-key K6 is depressed, the content of the updated memory MIn is transferred back and set to the memories MNn, MAn, MBn, MCn or MDn in accordance with the relevant operation mode. If a mode other than the normal default mode has been selected once, it cannot be selected again unless the power source is turned off.

As described above, when the Mode D is selected, the first cycle (Y, C and M) is executed with the parameters for the Mode B, before the second cycle is executed with the parameters for the Mode C. Parameters for the first cycle and those for the second in the Mode D can be modified independently from each other by updating the parameters for the Mode B and the parameters for the Mode C. This increases the flexibility in adjusting the tone reproduction characteristics (OD-CD) in the Mode D.

Those values for best conforming to the ideal characteristic, the summed up characteristic (A+B) shown in FIG. 6*d*, are automatically set respectively to the memories MBn and MCn (n=1–3) at the initialization. In this case, the content of the memory MBn is set to such a characteristic as to cover low density region or for the entire region as shown by the characteristic A in FIG. 6*d*, whereas the content of the memory MCn is set to such a characteristic as to compensate dark area reproduction, as shown by the characteristic B in FIG. 6*d*. The data to be set therein are previously stored in the read only memory (ROM) of the main control board 100. Accordingly, if the Mode D is selected, most theoretically preferred characteristic can automatically be set after the power source has been turned on, without any modification of the density parameters. Further, "8" is set always to the memory MDn upon initial setting.

Referring again to FIG. 8, when the print key K5 is depressed, that is, when the print start flag is set in the key input subroutine as described above, the copy process is started. Each of the subroutines for scanner, lamp, charge, transfer, separation, development bias, filter and clamper control, as well as other controls are repeatedly executed in a short period till the copy has been completed.

Figure 10A:
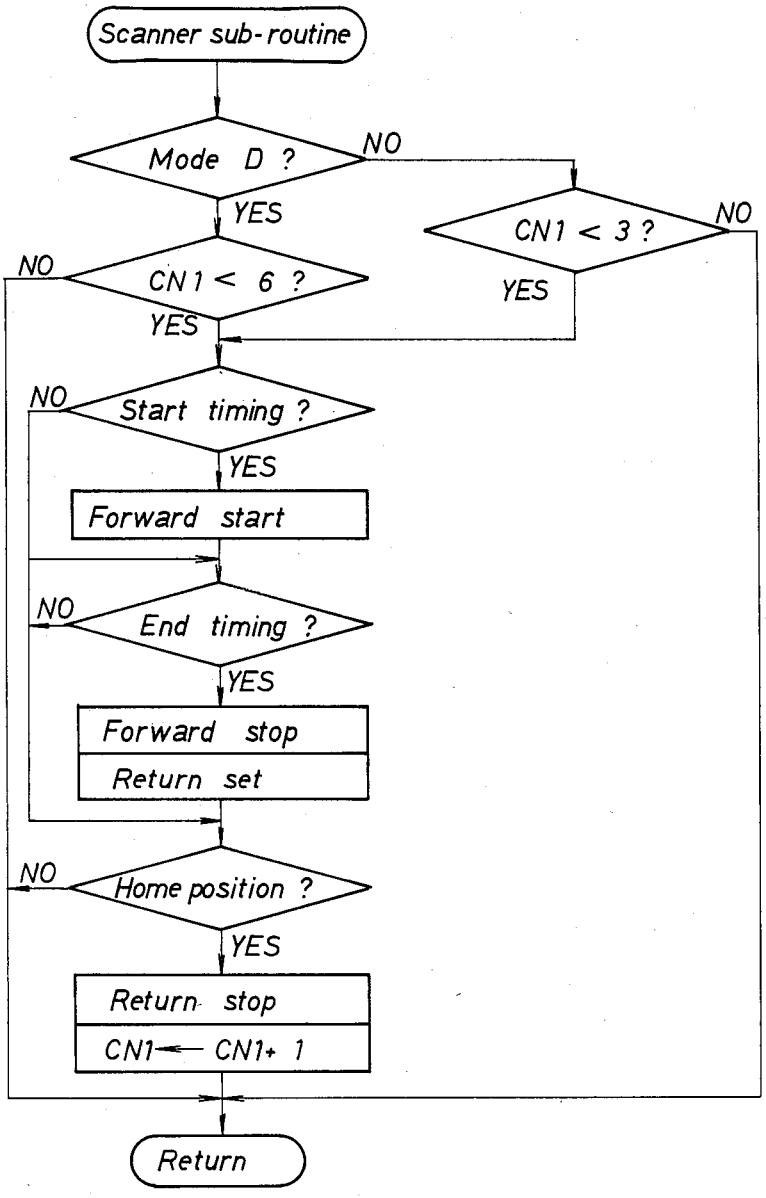

Scanner subroutine will be explained while referring to FIG. 10*a*. At first, it is judged if the Mode D is selected or not, that is, the content of the register R1 is 4 (Mode D) or not. The following processings are conducted if the content of the counter CN1 is less than 6 in the case of the Mode D and if the content of the counter CN1 is less than 3 in the case of other than the Mode D, respectively. The content of the counter CN1 is cleared to "0" upon starting the copy process.

When the start timing for the scanner is attained, the forwarding scanning drive for the scanner is started. In this embodiment, the scanner is driven by the main motor M1 upon forward scanning. Then, if the scanning end timing has been attained, the forward scanning of the scanner is discontinued and the scanner return drive is started. In this embodiment, the scanner is driven backward by the exclusive return motor M8. Either one is selectively connected with the scanner by means of a clutch not illustrated. When the home position sensor SE8 of the scanner detects the home position, the return drive is stopped and the counter CN1 is incremented (+1). That is, scanning is repeated for six times in the Mode D and three times otherwise. These timings are taken by counting the number of pulses from a timing generator (not illustrated) that outputs pulses in synchronization with the drive of the main motor from the start of the copying operation.

Figure 10B:
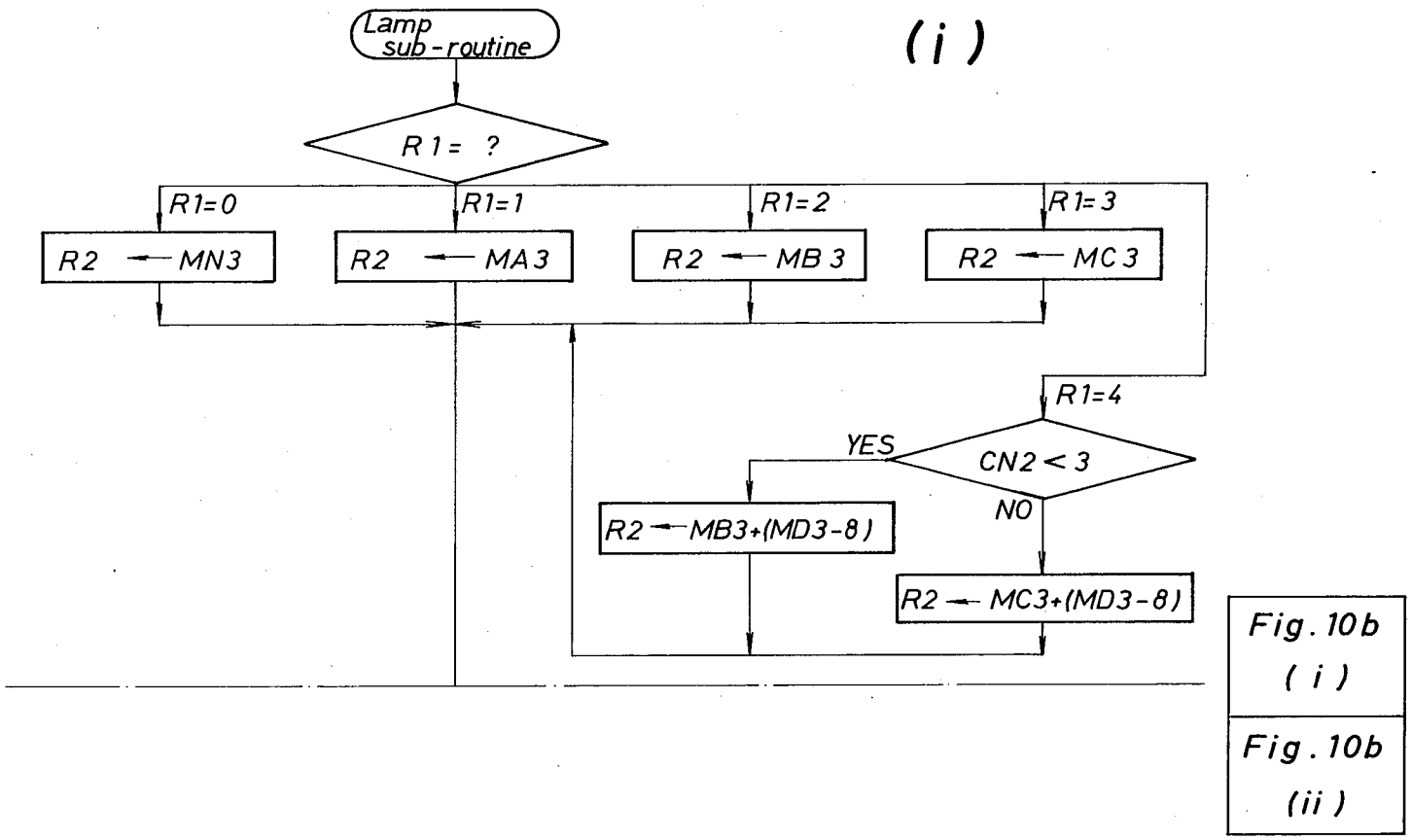
Figure 10B:
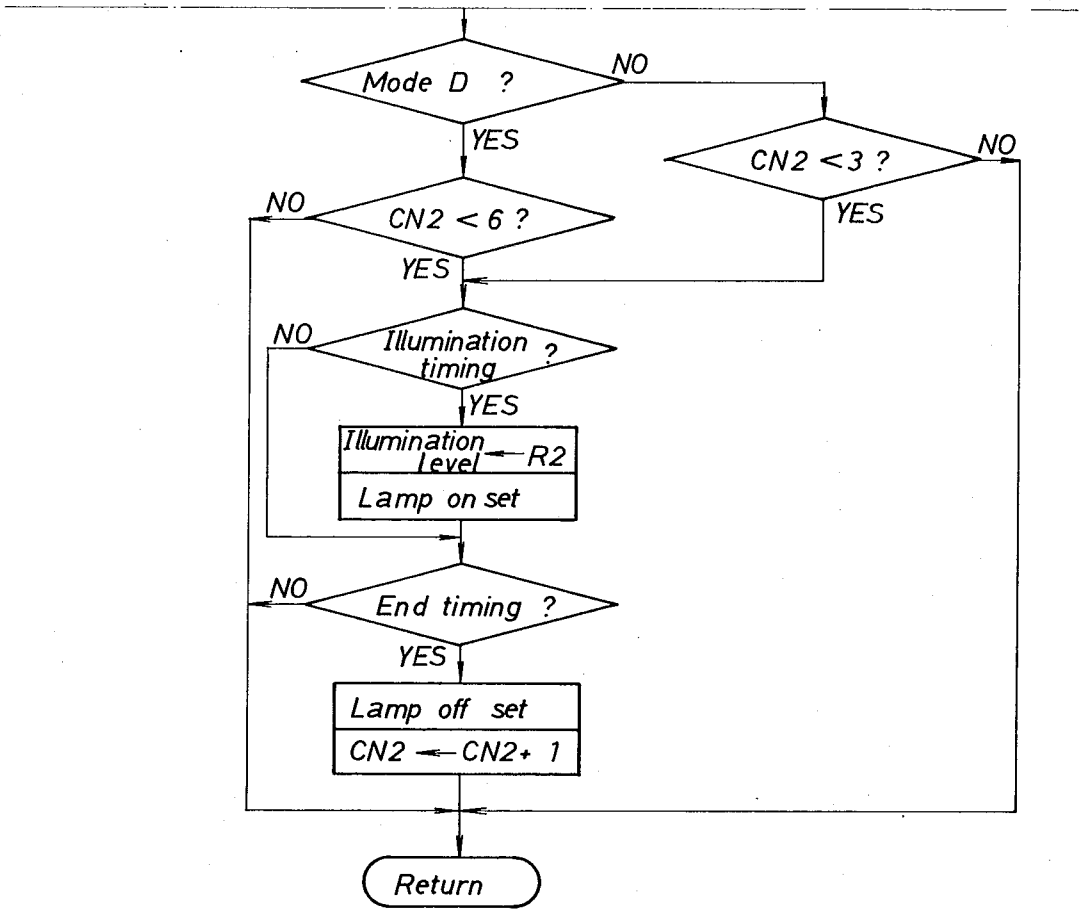

Explanation will be made to the lamp subroutine while referring to FIG. 10*b*. At first the content of the register R1 is referred to and the processing is carried out depending on the value. If the content of the register R1 is 0, 1, 2 or 3, the content of one of the memories MN3, MA3, MB3 and MC3 is loaded to the register R2, respectively. If the content of the register R1 is "4", that is, in the Mode D, the value corresponding to the content of the counter CN2 is loaded to the register R2. The content of the counter CN2 indicates the number of lighting for the illumination lamp from the start of the copying process. Accordingly, the content of the counter CN2 should be cleared to "0" upon start of the copy process. If the content of the counter CN2 is less than "3", the result of the calculation for MB3+(MD3−8) is loaded to register R2, otherwise, the result of the calculation: MC3+(MD3−8) is loaded to the register R2.

Then, it is judged if the mode is D or not, and the following proceedings are executed if the content of the counter CN2 is less than 6 in the case of the Mode D, or if the content of the CN2 is less than 3 in the case other than Mode D. That is, if the timing for the start of the exposure has been attained, the exposure level for the illumination lamp 3 is set according to the content of the register R2 and the lamp is set to on. When it comes to an end timing, the lamp is set to off and the content of the counter CN2 is incremented. Accordingly, exposure is repeated for six times in the Mode D, three times otherwise.

The actual voltage that the lamp regulator 190 issues is associated with the content of the register R2. In this particular example, the minimum is 90 V and there are 32 steps with an increment of 2.5 V, the maximum being 170 V.

As has been described above, the density parameter set for the Mode D, that is, the exposure level is: MB3+(MD3−8) in the first cycle (CN2=0−2) and MC3+(MD3−8) in the second cycle (CN2=3−5). Accordingly, if the MD3 is modified from "8", parameters used both for the first and the second cycles are amended without changing MB3 and MC3, since the amount of the amendment is given as a deviation relative to the standard value "8" of MD3. This means that, if the MB3 and MC3 have been set so that the summed up characteristic (Mode D) conforms to the ideal characteristic, the overall superimposed characteristic, that is, the characteristic both for the low density (highlight) region and the high density (shadow) region can be controlled by merely modifying a parameter (MD3) for the Mode D. This can simplify the control and decrease the number of necessary test copies.

Figure 10C:
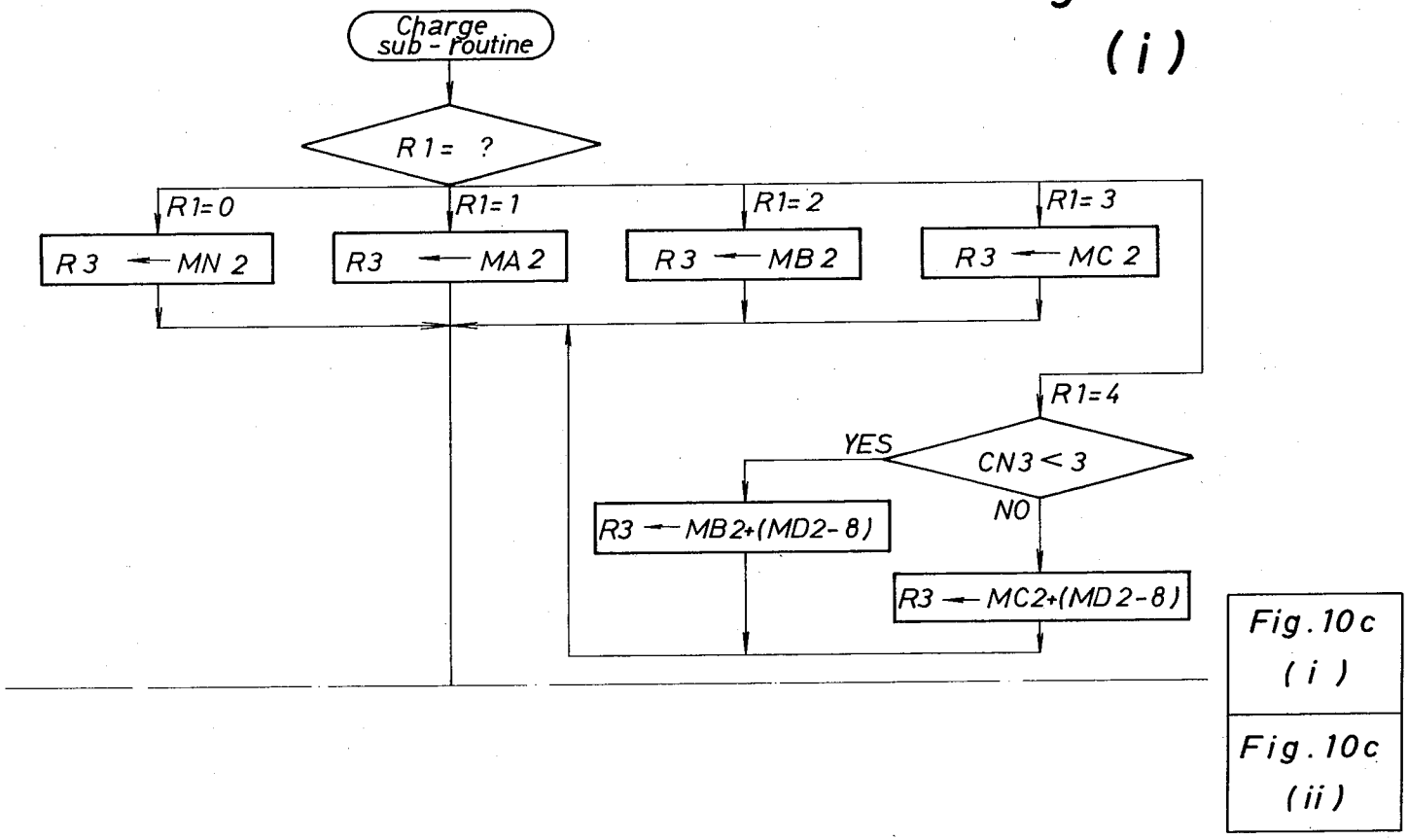

Description will now be made to the charge subroutine while referring to FIG. 10*c*. At first, the content of the register R1 is referred to. If the content of the register R1 is 0, 1, 2 or 3, the content of the memory MN2, MA2, MB2 or MC2 is loaded to the register R3, respectively. If the content of the register R1 is "4", that is, the Mode D, a value corresponding to the content of the counter CN3 is loaded to the register R3. The counter CN3 indicates the number of energization for the main charger from the start of the copy process. Accordingly, the content of the counter CN3 should be cleared to "0" upon start of the copy. If the content of the counter CN3 is less than "3", the result of the calculation: MB2+(MD2−8) is loaded to the register R3, while if the content of the counter CN3 is 3 or more, the result for the calculation: MC2+(MD2−8) is loaded to the register R3.

Then, it is judged if the mode is D or not and the following proceedings are executed if the content of the counter CN3 is less than 6 in the case of the Mode D, or if the content of the counter CN3 is less than 3 in the case other than the Mode D. That is, if the timing for starting the energization for the main charger has been attained, application voltage to the main charger 10 is set according to the content of the register R3 and the voltage is applied. Further, if it comes to the end timing, the application voltage is set to "0" and the content of the counter CN3 is incremented. Accordingly, energization for the main charger is repeated by six times in the Mode D and three times otherwise. Other explanations relating to R2 are applicable similarly to R3.

The current applied to the main charger 10 is associated with the content of the register R3. In this particular example, the minimum is 106 μA and there are 62 steps with an increment of 7 μA, the maximum being 540 μA.

Figure 10D:
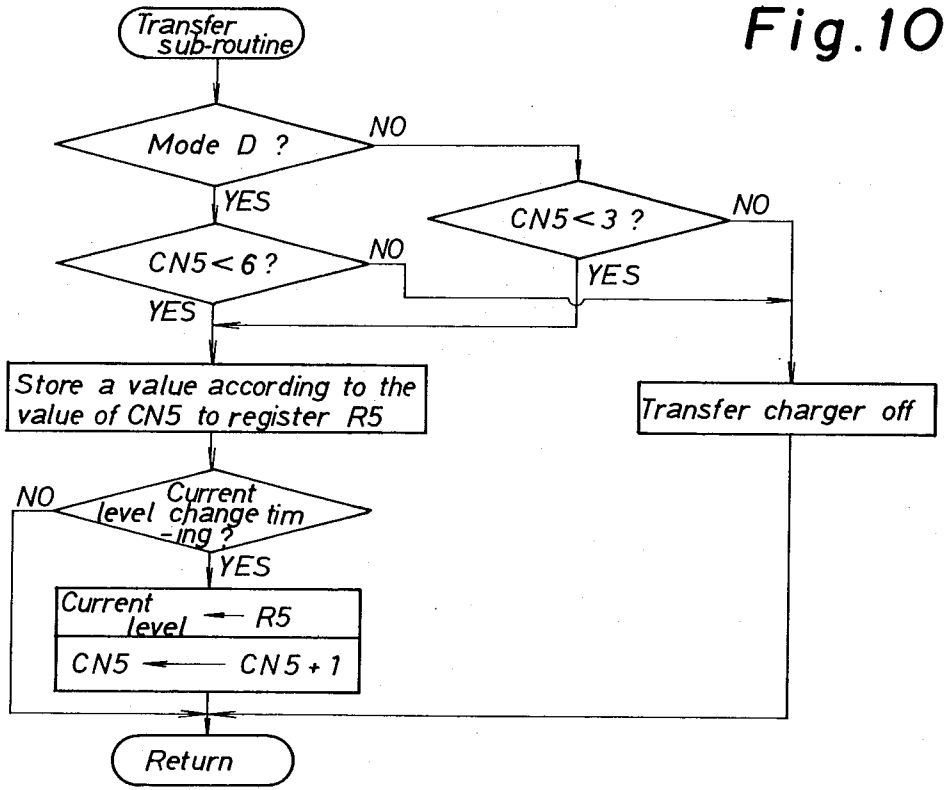

Description will now be made to transfer subroutine while referring to FIG. 10*d*. The similar process is repeated using CN5 and R5. The transfer charger is switched according to the value of the register R5 on every time the current switching timing comes. The transfer charger is turned off (current value to 0) when the six transfers have been completed in the case of the Mode D or three in the case of the mode other than D. In this embodiment, the energizing current to the transfer charger is set as described below:

OTHER THAN MODE D:
- First transfer (Y) . . . 150 μA
- Second transfer (C) . . . 250 μA
- Third transfer (M) . . . 400 μA MODE D:
- First transfer (Y) . . . 150 μA
- Second transfer (C) . . . 250 μA
- Third transfer (M) . . . 400 μA
- Fourth transfer (Y) . . . 250 μA
- Fifth transfer (C) . . . 400 μA
- Sixth transfer (M) . . . 600 μA As has been described above, the current value is increased on every change timing, because when the transfer process is executed the transfer drum is charged and therby reduces the efficiency in the succeeding transfers. Without an interim elimination, the increase step cannot be reserved. However, an interim elimination after the third transfer enables to decrease the transfer current at the fourth transfer from that at the third.

Figure 10E:
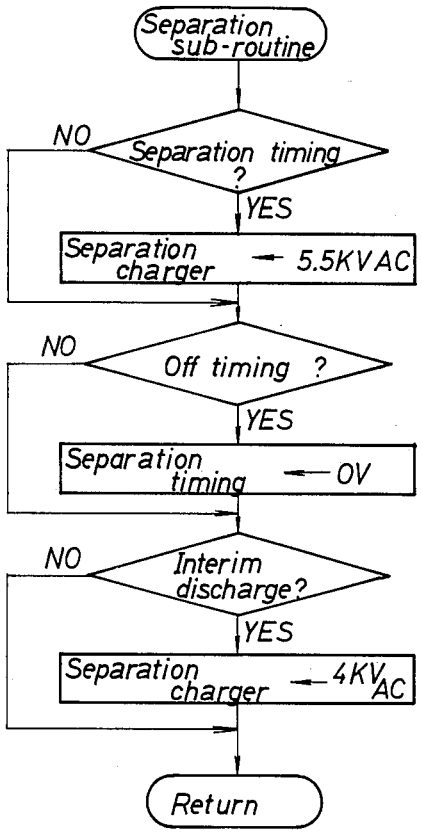

Description will be made to the separation subroutine while referring to FIG. 10*e*. In this subroutine, when it comes to the separation timing, an AC voltage of 5.5 KV is applied between the separation chargers 22 and 23. When the off timing comes, the voltage is set to "0". Further, when the timing for the interim elimination comes, an AC voltage at 4 KV is applied between the separation chargers 22 and 23. When the transfer processes are repeated, the surface of the transfer drum 2 is charged to the following potential:

- First transfer . . . about 500 V
- Second transfer . . . 1000–1500 V
- Third transfer . . . 2000–3000 V In view of the above in this embodiment, an AC voltage at 4 KV is applied to the separation chargers when the third transfer has been completed to partially eliminate the charge to the surface potential of 500–1000 V. This residual potential serves to hold the recording sheet to the transfer drum 2. When an AC voltage at 5.5 KV is applied to the separation charger, the surface potential of the transfer drum 2 decreases approximately to 0 V and the recording sheet is separated from the transfer drum 2.

Figure 10F:
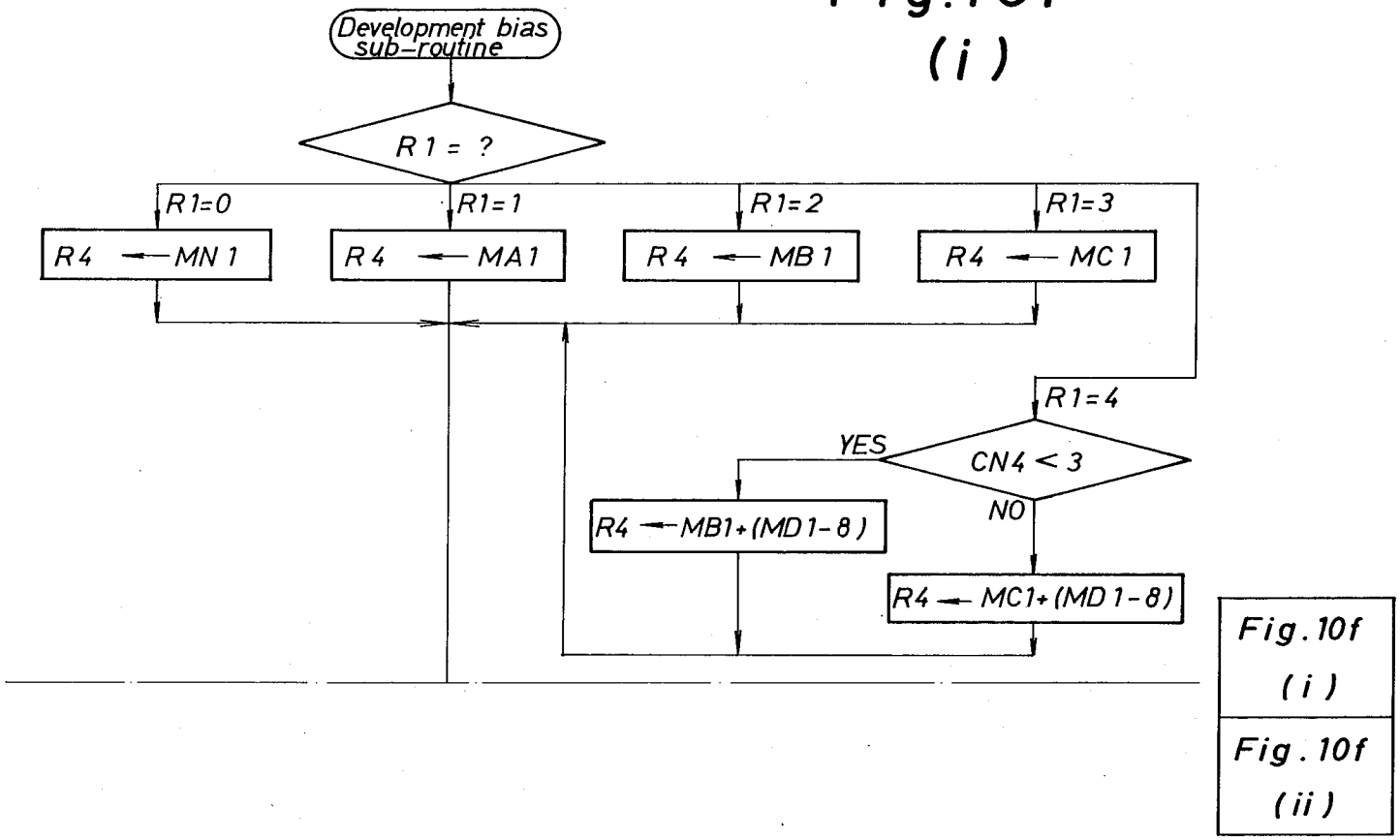

Then, the development bias subroutine will be explained while referring to FIG. 10*f*. As in other subroutines, the register R1 is at first referred to and the register R4 is loaded with an appropriate value according to R1 and CN4.

Then, it is judged if it is in the Mode D or not, and the following proceedings are executed if the content of the counter CN4 is less than 6 in the case of the Mode D, or if the content of the counter CN4 is less than 3 otherwise. That is, if the timing is right for applying the development bias potential, a voltage corresponding to the content of the register R4 is set and applied to the development electrode. Further, at the bias off timing, the voltage is set to "0", and the content of the counter CN4 is incremented. The rest are the same as the other parameters.

The development bias potential applied to the development electrode of the respective development unit (Y, C or M) is associated with the content of the register R4. In this particular example, the minimum is 100 V and there are 15 steps with an increment of 12 V, the maximum being 280 V.

Figure 10G:
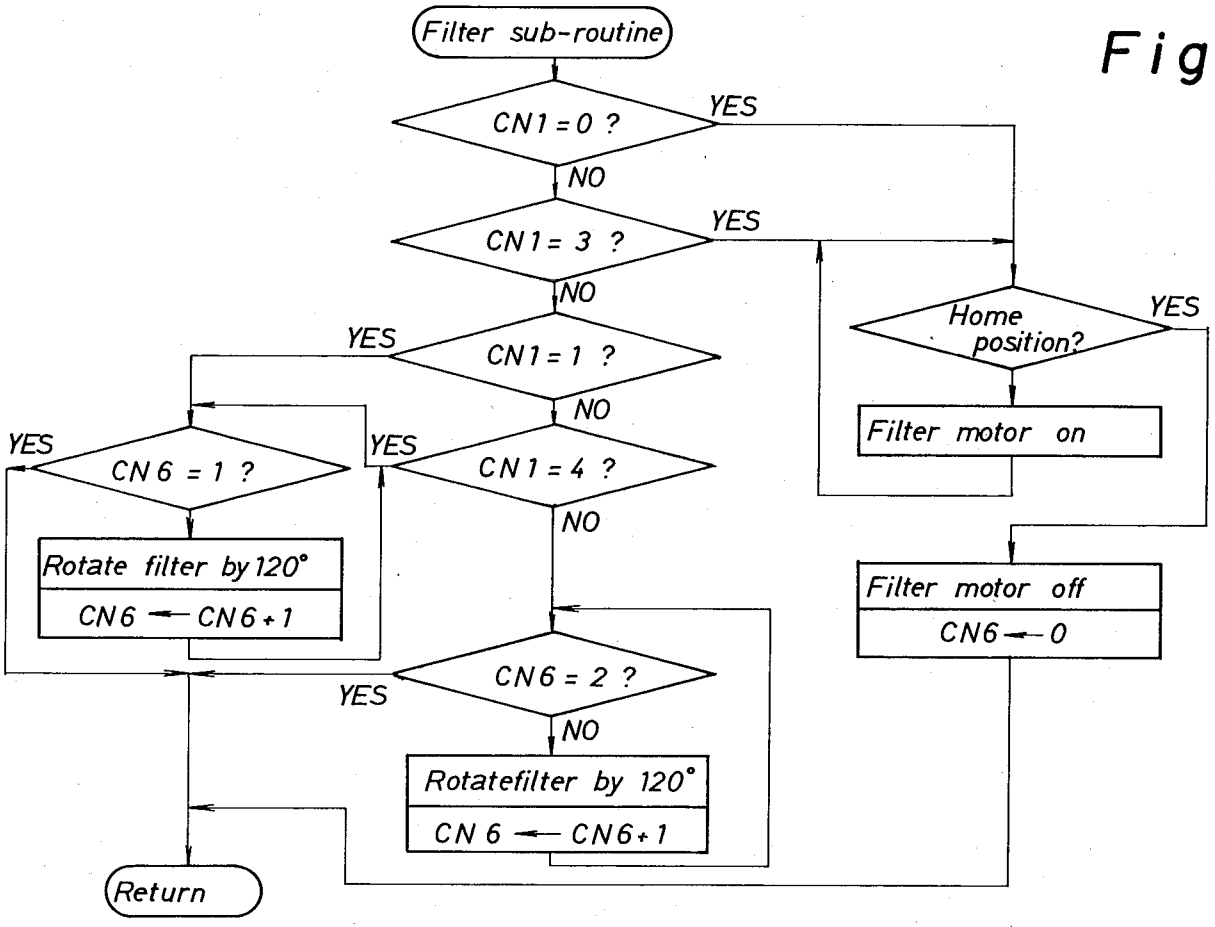
Figure 10H:
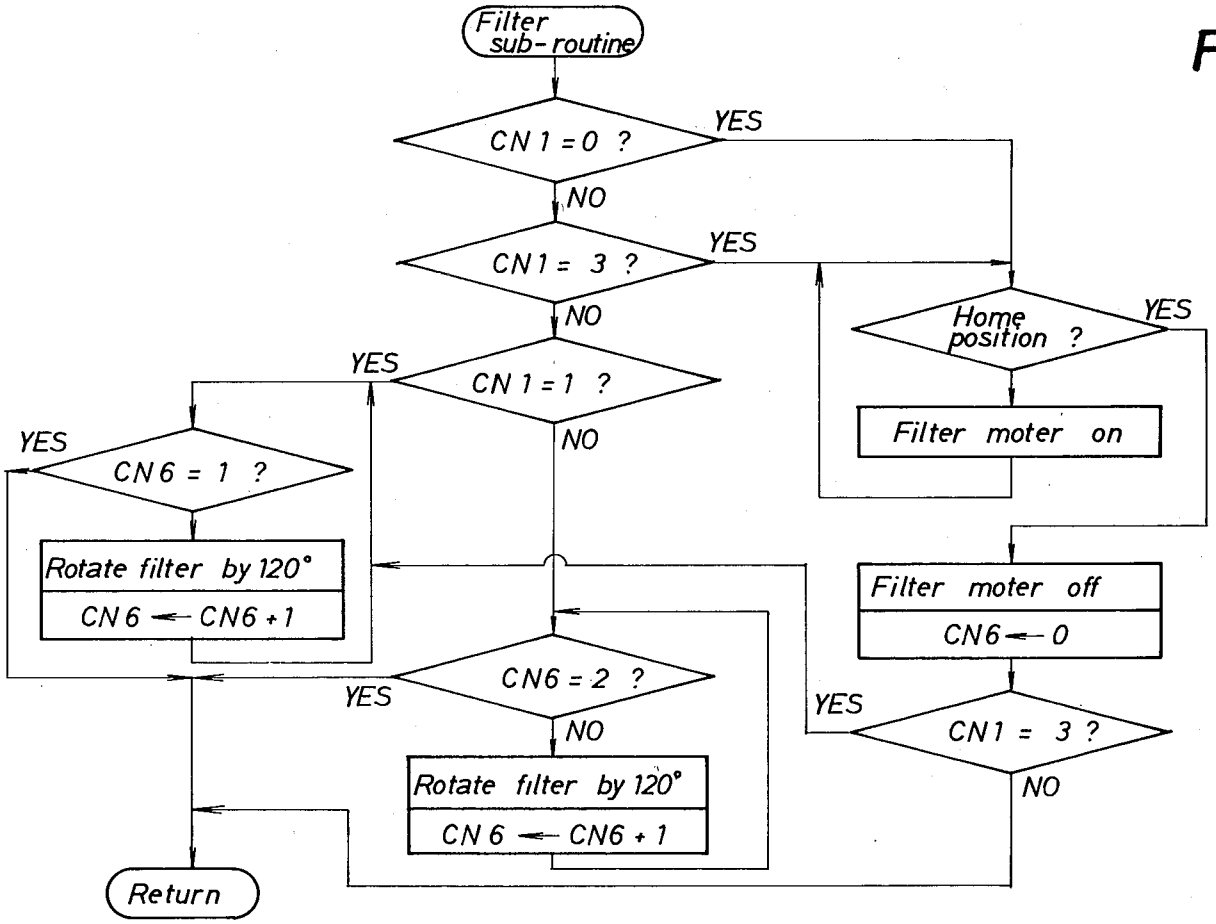

Lastly, description will be made to the filter subroutine while referring to FIG. 10g. In this subroutine, the content of the counter CN1 holding the number of scanning is referred to and the color of the color separation filters 9 is selected depending thereon. That is, if the content of the counter CN1 is "0" or "3", it is checked if the position of the color separation filters is at the home position or not. If not, the filter motor M5 is driven till the home position is detected. At the home position, the filter motor M5 is stopped and the counter CN6 is cleared to "0". In the case where the content of the counter CN1 is "1" or "4", the content of the counter CN6 is checked. If it is not "1", the color separation filters 9 are rotated by 120° by driving the filter motor M5 and the content of the counter CN6 is incremented. If the content of the counter CN1 is "2" or "5", the content of the counter CN6 is checked. If it is not "2", the color separation filters 9 are rotated by 120° by the driving of the filter motor M5 and the content of the counter CN6 is incremented.

Thus, the blue filter plate (B) is inserted into the path if the content of the counter CN1 is "0" or "3", the red (R) if the content of the counter CN1 is "1" or "4" and the green (G) if the content of the counter CN1 is "2" or "5".

In the color copier shown in FIG. 2, a monochromatic copy for any one of colors Y, C and M is possible, although such a mode is omitted in the flow charts illustrated in the drawings. In the monochromatic mode, like in the color mode, both the single cycled and the dual cycled operations are possible, the latter offering better tone reproduction.

Figure 1:
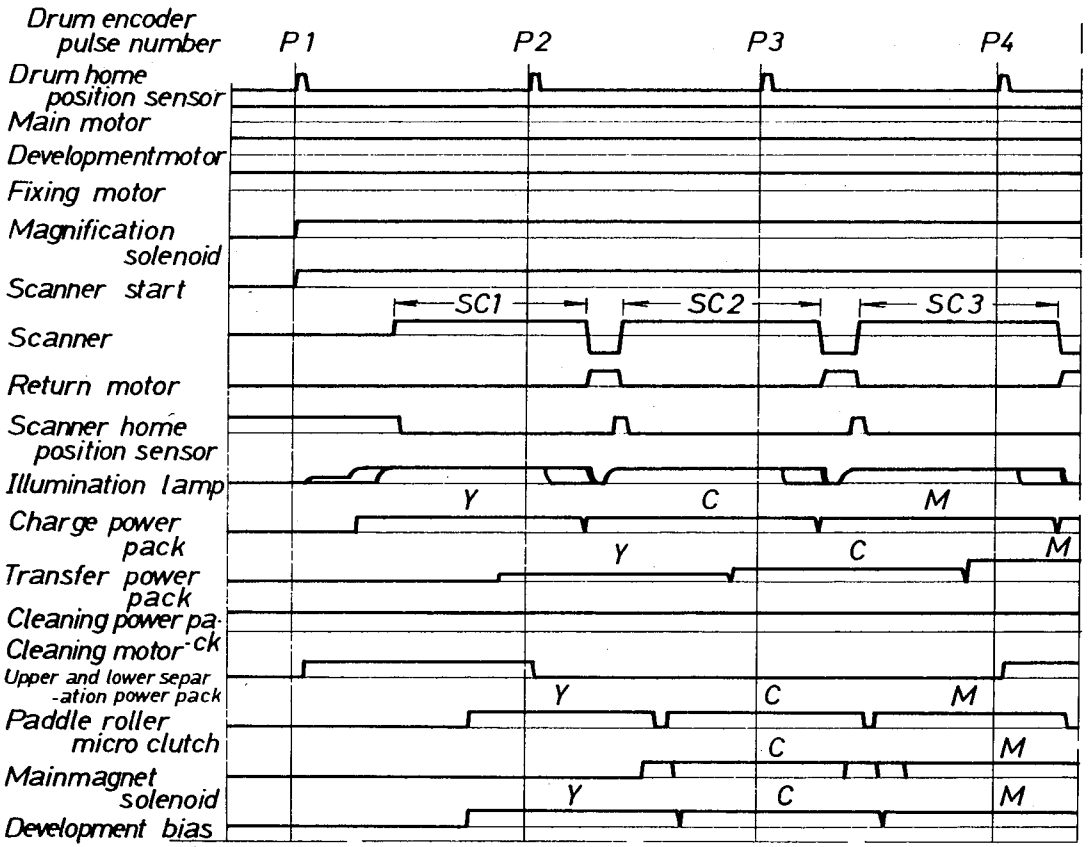
FIG. 1, divided into four sections, is a timing chart showing a preferred embodiment of the present invention when operated in Mode D, a dual cycled full color recording.

FIGS. 1 and 7 show the operation timings, in the Mode D and the mode other than D, respectively. Referring to FIG. 1, in the Mode D, it can be seen that the scanner, exposure, charge, development, transfer, etc. are repeated by six times for one copy. While on the other hand, in the operation mode shown in FIG. 7, those are repeated for three times. While the Mode D offers a superior tone reproduction, other "high speed" modes is suitable if the quality requirement is mild.

In another example which is explained hereunder, the operation is somewhat simplified. After the first cycle and the interim elimination are performed as in the first example, the second cycle includes only the cyan and magenta proceedings but not the yellow. To accomplish this, the timing chart illustrated in FIG. 1 is changed as shown in FIG. 12. The necessary changes in flows from the ones of the preceding example will be clear to those skilled in the art, but the modified filter subroutine is illustrated in FIG. **10*h***. The blue filter is used only when CN1 is zero in this subroutine.

In this second example, there is one more difference. If the value of the memories MBn's is updated, the MCn's are calculated according to the quadratic equations:.

$$MC1 = Ka.MI1^2 + Kb.MI1 + Kc \quad (1)$$

$$MC2 = Ka.MI2^2 + Kb.MI2 + Kc \quad (2)$$

$$MC3 = Ka.MI3^2 + Kb.MI3 + Kc \quad (3)$$

wherein MIn's are the same as MBn's under this mode. The standard values for the coefficient Ka, Kb and Kc are assigned during the initialization, but may be modified to the users' taste according to the flow exemplified in FIG. *9d*.

A rather unexpected advantage, which is common to the above two examples, is the decrease of undesirable streaks that occasionally appear on the copy. By the dual cycled mode in accordance with the present invention, these defects are offset from one cycle to another and have disappeared.

Various modifications will become possible for those skilled in the art after receiving the teachings of the present disclosure without departing from the scope thereof. For example, while the light exposure level of the illumination lamp is utilized as the parameter in the foregoing embodiments, a diaphragm means may be disposed in the path of the optical scanning system. Further, an analog type color copier is shown in the above-embodiments, but this invention is also applicable to other various types of recording apparatus for effecting the similar electrostatic transfer type recording process.

What is claimed is:

1. An image recording device of electrostatic transfer type with improved tone reproduction capability which includes:

charge support means which is a photoconductive layer having an electrically conductive backing material coupled therewith;

latent image forming means capable of forming electrostatic latent image on said charge support means;

development means which visualizes the electrostatic latent image with colored developer;

transfer means which transfers the visualized image to a recording sheet;

first setting means for at least one parameter which relates to said latent image forming means, said development means and/or said transfer means and is capable of adjusting the density of the recorded image;

second setting means for at least one parameter which relates to said latent image forming means, said development means and/or said transfer means and is capable of adjusting the density of the recorded image; and electronic control means which controls said latent image forming means, said development means and said transfer means so that the first recording cycle, wherein an electrostatic latent image is formed on said charge support means before it is visualized and transferred to recording sheet in response to the parameter(s) established by said first setting means, and the second recording cycle, wherein another electrostatic latent image is formed again on said charge support means before it is visualized with a developer in the same color as the one used in said first recording cycle and is transferred to the same recording sheet in response to the parameter(s) established by said second setting means, are performed.

2. An image recording device according to claim 1, wherein said transfer means comprises a rotatable transfer drum on which a recording sheet support means is provided.

3. An image recording device according to claim 2, wherein said recording sheet support means comprises a mechanical clamp capable of securely holding the recording sheet from movement both in the feed direction and in the transverse direction so that the exact positioning between any two transfer processes is assured.

4. An image recording device according to claim 2, wherein said charge support means is a rotatable drum placed in parallel and closely to, but not in contact with, said rotatable transfer drum.

5. An image recording device according to claim 4, wherein the two drums are interconnected with each other by means of gears enabling a precise synchronization of the two.

6. An image recording device according to claim 1, wherein each of said first setting means and said second setting means is a memory and said electronic control means includes a mode selection switch means and a parameter setting means, said mode selection switch means selecting first or second mode according to which the parameter established by said parameter setting means is assigned to the respective memory.

7. An image recording device according to claim 6, wherein said electronic control means stores two standard sets of initial values for said parameters relating to the density of the recorded image, the second of which covers the higher density region in comparison with the first, and moves said two standard sets to the respective memory during the initialization procedure.

8. An image recording device according to claim 6, wherein said development means has at least three kinds of developer of different color and said electronic control means performs, during each recording cycle, a plurality of operations with developer of different colors in turn and said memory provides an area sufficient for said parameters which is established for each color.

9. An image recording device according to claim 8, wherein said colors of the developer are yellow, cyan, magenta and black.

10. An image recording device according to claim 8, wherein said colors of the developer are yellow, cyan and magenta.

11. An image recording device according to claim 9 or 10, wherein yellow is processed first.

12. An image recording device according to claim 9, wherein black is processed last.

13. An image recording device according to claim 8, wherein, during said first recording cycle, the operations are performed with respect to all colors, while, during the second, the operations with respect to at least one color are omitted.

14. An image recording device according to claim 10, wherein, during said first recording cycle, the operations are performed with respect to yellow, cyan and magenta, while, during the second, the operation with respect to yellow is omitted.

15. An image recording device according to claim 8, wherein each of said at lest three kinds of developer of different color comprises a mixture of a carrier and a powdered resinous pigment or dye.

16. An image recording device according to claim 15, wherein said powdered resinous pigment or dye comprises a powdered organic resin and a pigment or a dye dispersed therein.

17. An image recording device according to claim 16, wherein said organic resin is a common material to all of said at least three kinds of developer of different color, while said pigment or dye is different in color with each kind of developer.

18. An image recording device according to claim 17, wherein said organic resin is thermoplastic and fuses below 90° C.

19. An image recording device according to claim 17, wherein said organic resin is a non-crystalline polyester.

20. An image recording device according to claim 16, which further includes:

fixation means which accepts the recording sheet from said transfer means and heats it until said powdered organic resin fuses to stick to the recording sheet and thereby captures said pigment or dye at the place where it is.

21. An image recording device according to claim 1, wherein said at least one parameter is selected from the group consisting of:

first parameter which affects the level of reading the manuscript image, second parameter which affects static voltage imparted upon said charge support means and third parameter which affects charge level of said developer.

22. An image recording device according to claim 21, wherein said first parameter is the voltage applied to a lamp of said latent image forming means which illuminates the manuscript to form the light pattern corresponding thereto, which then is exposed on said photoconductive layer.

23. An image recording device according to claim 21, wherein said second parameter is the voltage applied to a charger, which charges uniformly said charge support means by way of corona discharge.

24. An image recording device according to claim 21, wherein said third parameter is the bias potential applied to a development electrode.

25. An image recording device according to claim 24, wherein said development means performs magnetic brush development.

26. An image recording device according to claim 8, which further includes:

operation mode selection switch means by which the number of cycles to be performed is controlled as either 1 or 2.

27. An image recording device according to claim 1, wherein the parameters to be established by said second setting means is calculated from the parameters established by said first setting means in accordance with predetermined interrelation.

28. An image recording device according to claim 27, wherein said predetermined interrelation can be modified by coefficient modification means.

29. An image recording device according to claim 27, wherein the parameter is the voltage applied to a lamp of said latent image forming means which illuminates the manuscript to form the light pattern corresponding thereto, which then is exposed on said photoconductive layer.

30. An image recording device according to claim 29, wherein the parameter to be established by said second setting means is 1.3–2.0 times of that established by said first setting means.

31. An image recording device according to claim 27, wherein the parameter is the voltage applied to a charger, which charges uniformly said charge support means by way of corona discharge.

32. An image recording device according to claim 31, wherein the parameter to be established by said second setting means is 0.5–1.0 times of that established by said first setting means.

33. An image recording device according to claim 27, wherein the parameter is the bias potential applied to a development electrode.

34. An image recording device according to claim 33, wherein the parameter to be established by said second setting means is 1.0–2.0 times of that established by said first setting means.

35. An image recording device according to claim 1, wherein the parameters to be established by both said first setting means and said second setting means are simultaneously increased or decreased by the same amount in response to a parameter modification means.

36. An image recording process with improved tone reproduction capability which comprises the steps of:

(a) sensitizing uniformly a photoconductive layer having an electrically conductive backing material coupled therewith;

(b) exposing said photoconductive layer to a light pattern image coming through a color separation filter;

(c) developing said photoconductive layer with a complementary developer in color corresponding to said color separation filter;

(d) transferring electrostatically the developed image to a recording sheet wrapped on a transfer drum;

(e) cleaning said photoconductive layer;

(f) repeating the steps (a)–(e) using a different color separation filter and a complementary developer corresponding thereto;

(g) modifying process conditions so that the recorded image would compensate the undesirable saturation of density under an ordinary condition and that the superimposed images have an improved tone reproduction;

(h) repeating the steps (a)–(f) under the modified process conditions;

(i) separating the recording sheet from the transfer drum; and (j) fixing the superimposed image on said recording sheet.

37. An image recording process according to claim 36, wherein the combinations of said color separation filter and the corresponding complementary developer are red-cyan, green-magenta and blue-yellow.

38. An image recording process according to claim 37, wherein in the step (h) only the red-cyan and the green-magenta combinations are repeated and the blue-yellow combination is omitted.

39. An image recording process according to claim 37, wherein said photoconductive layer has a panchromatic spectral response and is sensitive to any color coming through said color separation filter.

40. An image recording process according to claim 39, wherein said photoconductive layer is made of vitreous selenium alloy.

41. An image recording process according to claim 36, which, either between the steps (f) and (g) or between the steps (g) and (h), further comprises the step of:

(k) partially discharging the potential accumulated upon the recording sheet during the repetitive transfers.

42. An image recording process according to claim 36, wherein the step (c) is accomplished by magnetic brush development.

43. An image recording process according to claim 36, wherein said developer comprises two components: carrier and powdered resinous pigment or dye.

44. An image recording process according to claim 43, wherein said powdered resinous pigment or dye comprises a powdered organic resin and a pigment or a dye dispersed therein.

45. An image recording process according to claim 44, wherein said organic resin is a common material to all of said at lest three kinds of developer of different color, while said pigment or dye is different in color with each kind of developer.

46. An image recording process according to claim 45, wherein said organic resin is thermoplastic and fuses below 190° C.

47. An image recording process according to claim 45, wherein said organic resin is a non-crystalline polyester.

* * * * *